US008550324B2

(12) United States Patent
Coleman

(10) Patent No.: US 8,550,324 B2
(45) Date of Patent: Oct. 8, 2013

(54) DEPTH ADJUSTMENT FOR FASTENING TOOL

(75) Inventor: Micah A Coleman, Baltimore, MD (US)

(73) Assignee: Black & Decker Inc., Newark, DE (US)

( * ) Notice: Subject to any disclaimer, the term of this patent is extended or adjusted under 35 U.S.C. 154(b) by 1756 days.

(21) Appl. No.: 11/439,391

(22) Filed: May 23, 2006

(65) Prior Publication Data

US 2007/0272422 A1 Nov. 29, 2007

(51) Int. Cl.
*B25C 1/06* (2006.01)
*B25C 1/00* (2006.01)

(52) U.S. Cl.
USPC ..... 227/142; 227/8

(58) Field of Classification Search
USPC ..... 227/142, 133, 131, 7–8, 109
See application file for complete search history.

(56) References Cited

U.S. PATENT DOCUMENTS

| | | | | |
|---|---|---|---|---|
| 1,823,644 | A | | 9/1931 | Cassock |
| 2,308,681 | A | | 1/1943 | Eason |
| 2,464,907 | A | | 3/1949 | Unruh |
| 2,915,156 | A | | 12/1959 | Horn |
| 3,067,724 | A | | 12/1962 | Jenny et al. |
| 3,140,492 | A | | 7/1964 | Bade |
| 3,519,186 | A | | 7/1970 | Volkmann |
| 3,554,428 | A | | 1/1971 | Smith |
| 3,893,610 | A | | 7/1975 | Smith |
| 4,129,240 | A | | 12/1978 | Geist |
| 4,212,379 | A | | 7/1980 | Zoino |
| 4,298,072 | A | | 11/1981 | Baker et al. |
| 4,372,202 | A | | 2/1983 | Cameron |
| 4,530,454 | A | | 7/1985 | Gloor et al. |
| 4,572,053 | A | | 2/1986 | Sosnowski et al. |
| 4,640,452 | A | | 2/1987 | Matt et al. |
| 4,720,033 | A | | 1/1988 | Olesen |
| 4,781,274 | A | | 11/1988 | Hendrickson |
| 4,807,793 | A | | 2/1989 | Ghibely |
| 4,811,885 | A | | 3/1989 | Lai |
| 4,924,988 | A | | 5/1990 | Page |
| 5,199,625 | A | | 4/1993 | Dewey et al. |
| 5,219,110 | A | * | 6/1993 | Mukoyama ..... 227/8 |
| 5,231,750 | A | | 8/1993 | Fealey |
| 5,263,842 | A | | 11/1993 | Fealey |
| 5,443,196 | A | | 8/1995 | Burlington |
| 5,511,715 | A | | 4/1996 | Crutcher et al. |
| 5,593,079 | A | * | 1/1997 | Mukoyama et al. ..... 227/8 |

(Continued)

FOREIGN PATENT DOCUMENTS

| | | |
|---|---|---|
| DE | 1 814 629 | 12/1968 |
| DE | 1 603 942 | 9/1971 |

(Continued)

*Primary Examiner* — Lindsay Low
(74) *Attorney, Agent, or Firm* — Harness, Dickey & Pierce, P.L.C.

(57) ABSTRACT

A fastening tool for driving a fastener into a workpiece includes a trigger assembly that activates a driver sequence that drives the fastener into the workpiece. A contact trip mechanism has a blocking member connected to a carrier member. The contact trip mechanism is moveable between an extended position and a retracted position. In the extended position, the blocking member prevents the trigger assembly from activating the driver sequence. A depth adjustment assembly includes an adjuster member moveable between at least a first position associated with a first depth setting and a second position associated with a second depth setting. The adjuster member is moveable to obstruct the carrier member, when the contact trip mechanism moves from the extended position to the retracted position.

17 Claims, 23 Drawing Sheets

(56) References Cited

U.S. PATENT DOCUMENTS

| | | | | |
|---|---|---|---|---|
| 5,785,227 | A * | 7/1998 | Akiba | 227/8 |
| 6,138,887 | A | 10/2000 | Nayrac et al. | |
| 6,145,724 | A | 11/2000 | Shkolnikov et al. | |
| 6,164,510 | A | 12/2000 | Deieso et al. | |
| 6,186,386 | B1 | 2/2001 | Canlas et al. | |
| 6,209,770 | B1 | 4/2001 | Perra | |
| 6,318,615 | B1 | 11/2001 | Walter | |
| 6,371,348 | B1 | 4/2002 | Canlas et al. | |
| 6,604,666 | B1 | 8/2003 | Pedicini et al. | |
| 6,626,348 | B2 | 9/2003 | Kitamura | |
| 6,705,503 | B1 | 3/2004 | Pedicini et al. | |
| 6,763,992 | B2 * | 7/2004 | Hirai | 227/142 |
| 6,766,935 | B2 | 7/2004 | Pedicini et al. | |
| 6,769,593 | B2 | 8/2004 | Pedicini et al. | |
| 6,866,177 | B1 * | 3/2005 | Chen | 227/142 |
| 6,971,567 | B1 | 12/2005 | Cannaliato et al. | |
| 2002/0185514 | A1 | 12/2002 | Adams et al. | |
| 2003/0066858 | A1 | 4/2003 | Holgersson | |
| 2006/0091177 | A1 * | 5/2006 | Cannaliato et al. | 227/8 |

FOREIGN PATENT DOCUMENTS

| | | |
|---|---|---|
| DE | 1 603 943 | 3/1972 |
| DE | 25 59 946 | 9/1980 |
| DE | 3031097 | 3/1981 |
| DE | 31 26 536 | 1/1983 |
| DE | G8434712 | 3/1985 |
| DE | 35 06 421 | 9/1986 |
| DE | 20009191 | 9/2000 |
| EP | 0119822 | 9/1984 |
| EP | 0255615 | 2/1988 |
| EP | 0 336 021 | 10/1989 |
| EP | 0546834 | 6/1993 |
| EP | 0 591 671 | 4/1994 |
| EP | 0 613 760 | 12/2000 |
| EP | 1 147 860 | 10/2001 |
| EP | 1 258 323 | 11/2002 |

* cited by examiner

DEPTH ADJUSTMENT FOR FASTENING TOOL

CROSS-REFERENCE TO RELATED REFERENCES

This application is related to the following references. U.S. Pat. No. 6,971,567, Ser. No. 10/978,869, titled Electronic Control of a Cordless Fastening Tool. U.S. patent application Ser. No. 10/978,868, titled Operational Lock and Depth Adjustment for Fastening Tool. U.S. patent application Ser. No. 10/978,867, titled Cordless Fastening Tool Nosepiece with Integrated Contact Trip and Magazine Feed. The references above are hereby incorporated by reference in their entirety as if fully set forth herein.

FIELD

The present invention relates to a cordless fastening tool and more specifically to a depth adjustment mechanism for the fastening tool.

BACKGROUND

Typically, fastening tools can employ relatively complicated depth adjustment mechanisms. These depth adjustment schemes can employ multi-piece components that can selectively disengage and lengthen or shorten to adjust the depth at which the fastening tool drives the fastener into the workpiece. While such depth adjustment schemes work well for their intended purpose, there is a need in the art for improved depth adjustment systems.

SUMMARY

The present teachings generally include a fastening tool for driving a fastener into a workpiece. The fastening tool includes a trigger assembly that activates a driver sequence that drives the fastener into the workpiece. A contact trip mechanism has a blocking member connected to a carrier member. The contact trip mechanism is moveable between an extended position and a retracted position. In the extended position, the blocking member prevents the trigger assembly from activating the driver sequence. A depth adjustment assembly includes an adjuster member moveable between at least a first position associated with a first depth setting and a second position associated with a second depth setting. The adjuster member is moveable to obstruct the carrier member when the contact trip mechanism moves from the extended position to the retracted position.

Further areas of applicability of the present teachings will become apparent from the detailed description and appended claims provided hereinafter. It should be understood that the detailed description and specific examples, while indicating various aspects of the present teachings are intended for purposes of illustration only and are not intended to limit the scope of the present teachings.

BRIEF DESCRIPTION OF THE DRAWINGS

The present teachings will become more fully understood from the detailed description, the appended claims and the accompanying drawings, wherein:

DETAILED DESCRIPTION

The following description of the various aspects of the present teachings is merely exemplary in nature and is in no way intended to limit the present teachings their application or uses.

Figure 1:
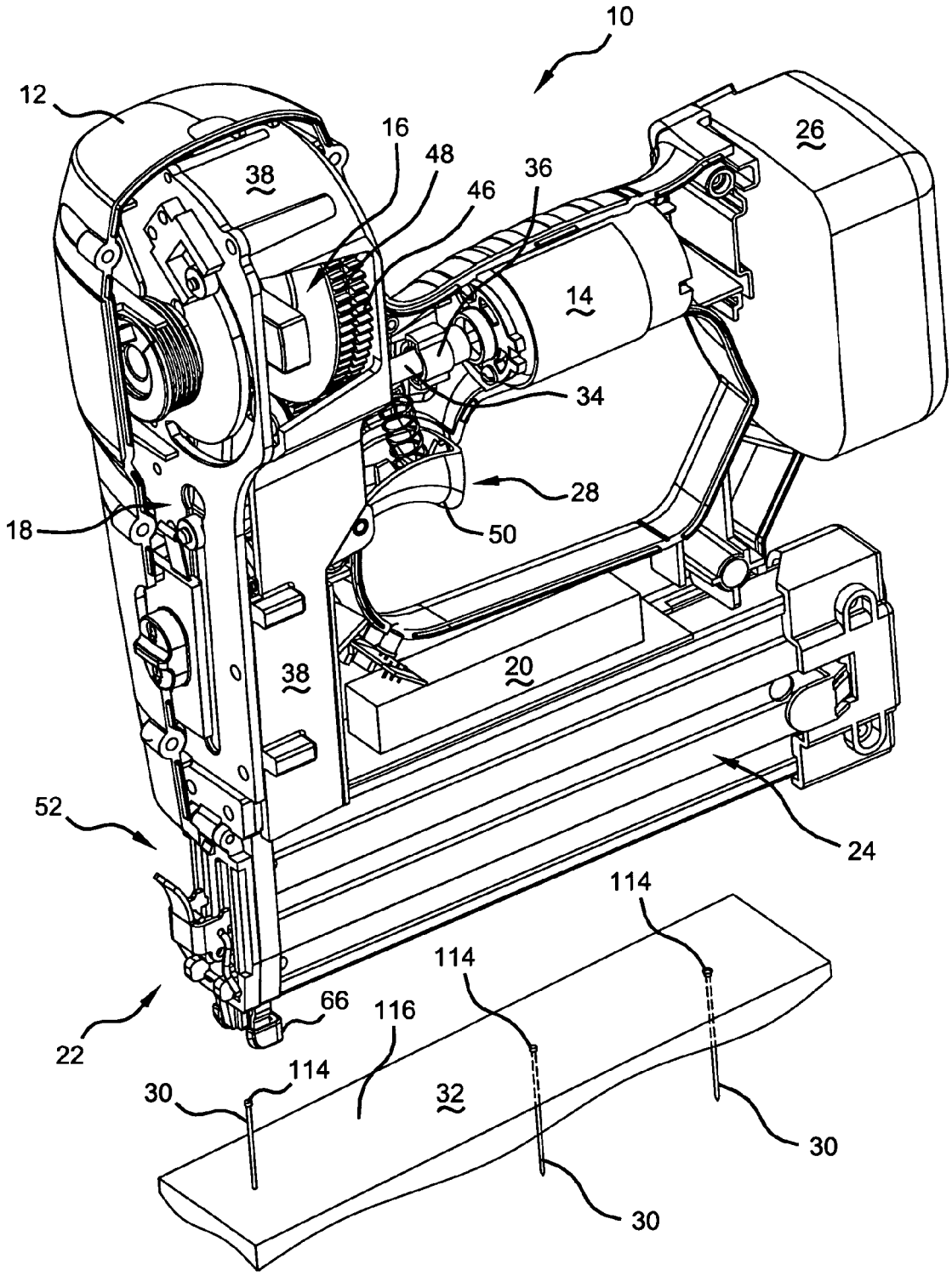
FIG. 1 is a perspective view of an exemplary cordless fastening tool in accordance with the present teachings showing exemplary fasteners and an exemplary workpiece.
Figure 2:
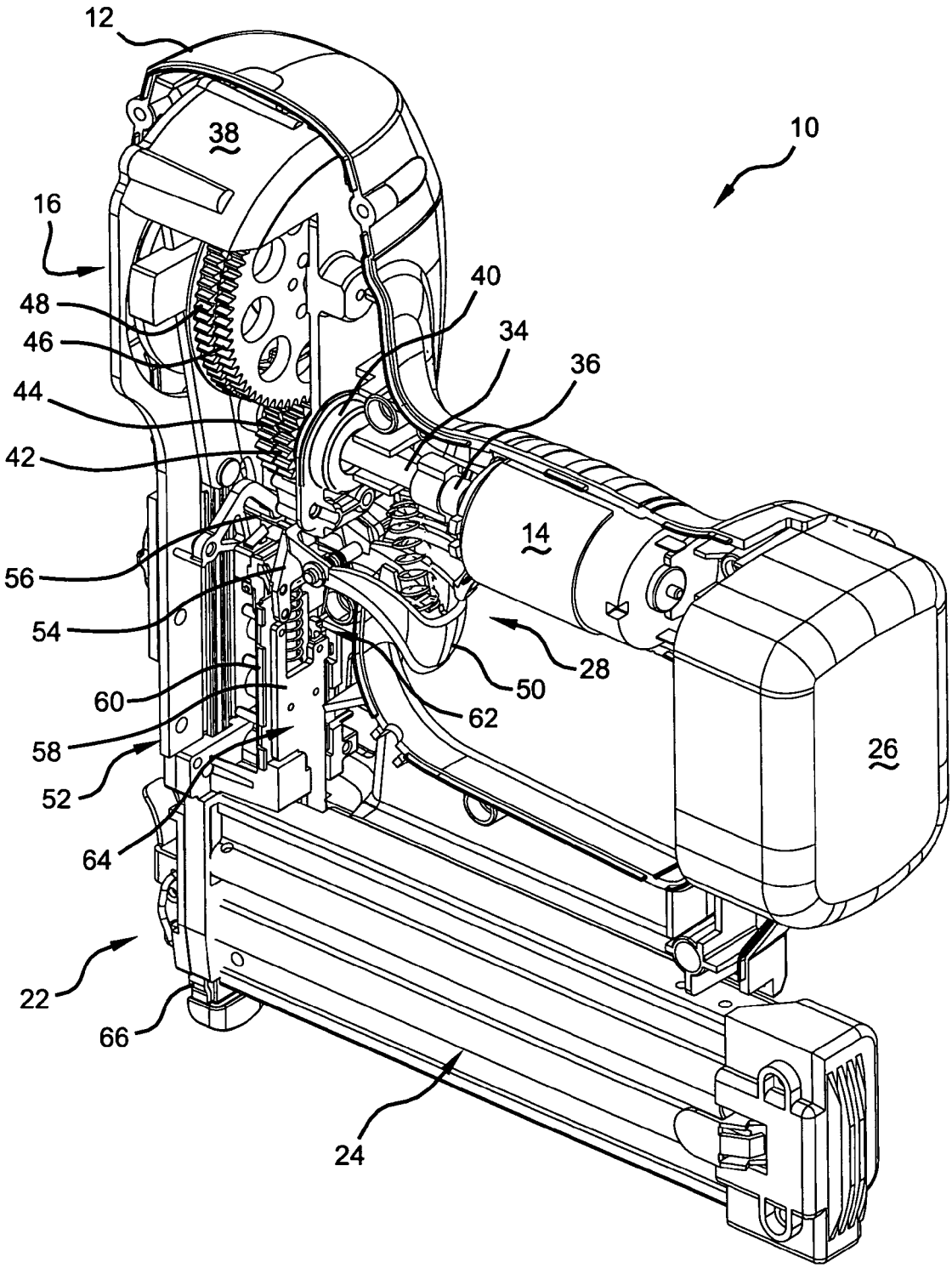
FIG. 2 is similar to FIG. 1 and shows a transmission, a driver mechanism and a depth adjustment mechanism in accordance with the present teachings.

With reference to FIGS. 1 and 2, a fastening tool 10 in accordance with various aspects of the present teachings generally includes an exterior tool housing 12, which may house a motor 14, a transmission 16, a driver mechanism 18 and a control module 20. The fastening tool 10 may also include a nosepiece 22, a fastener magazine 24 and a battery 26. The fastener magazine 24 may be coupled to the driver mechanism 18, while the battery 26 may be mechanically coupled to the tool housing 12 and electrically connected to the motor 14.

The motor 14 may be selectively activated by a trigger assembly 28 to execute a driver sequence. In doing so, the motor 14 may drive the transmission 16, which in turn may actuate the driver mechanism 18. Actuation of the driver mechanism 18 may drive fasteners 30, which are sequentially fed from the fastener magazine 24 into the nosepiece 22 and then, as needed, into a workpiece 32. The fasteners 30 may be nails, staples, brads, clips or any such suitable fastener or combinations thereof that may be driven into the workpiece 32.

With reference to FIG. 2, a driveshaft 34 may connect an input (not specifically shown) of the transmission 16 to an output shaft 36 of the motor 14. A transmission housing 38 may encase the transmission 16, a portion of a driveshaft 34 and various components of the transmission 16. A driveshaft bearing 40 may be employed to journal the driveshaft 34 for rotation in the transmission housing 38. The transmission 16 may include a first drive gear 42 and a second drive gear 44 that may be coupled for rotation with the driveshaft 34 within the transmission housing 38. The first drive gear 42 may be closer to the motor 14 relative to the second drive gear 44. It will be appreciated that the driveshaft 34, the first drive gear 42 and the second drive gear 44 may rotate at the same rotational velocity.

The transmission 16 may also include a flywheel 46 and a cam gear 48 that may be mounted for rotation on a transmission shaft (not specifically shown). The flywheel 46 and the cam gear 48 may meshingly engage and may be driven by the first and second drive gears 42, 44, respectively. After a predetermined number of rotations (or a portion thereof), the cam gear 48 may engage the driver mechanism 18 via a pin (not shown) causing the driver mechanism 18 to insert the fastener 30 into the workpiece 32. It will be appreciated that the trigger assembly 28 can be activated (e.g., a trigger 50 can be retracted) to start the rotation of the flywheel 46 and the cam gear 48.

In the various aspects of the present teachings, a contact trip mechanism 52 may interfere with the trigger assembly 28 and may prevent activation of the motor 14 and thus may prevent rotation of the flywheel 46 and cam gear 48. The fastening tool 10 may be pressed against the workpiece 32 to move the contact trip mechanism 52 from an extended condition (FIGS. 3B and 8A) to a retracted condition (FIGS. 3C and 8B). In doing so, a blocking member 54 may move from a blocked position (FIGS. 3B and 8A) to an unblocked position (FIGS. 3C and 8B). In the blocked position, an actuation member 56 associated with the trigger assembly 28 may be prevented from activating the driver sequence. The contact trip mechanism 52, therefore, may be configured to prevent the fastening tool 10 from executing the driver sequence that drives the fastener 30 into the workpiece 32 unless the blocking member 54 is positioned in the unblocked position through positioning of the contact trip mechanism 52 in the retracted position (e.g., pressed against the workpiece 32). Further details of the operation and construction of the fastening tool 10 are outside the scope of the present teachings but are disclosed in the commonly assigned references already disclosed above.

Figure 3A:
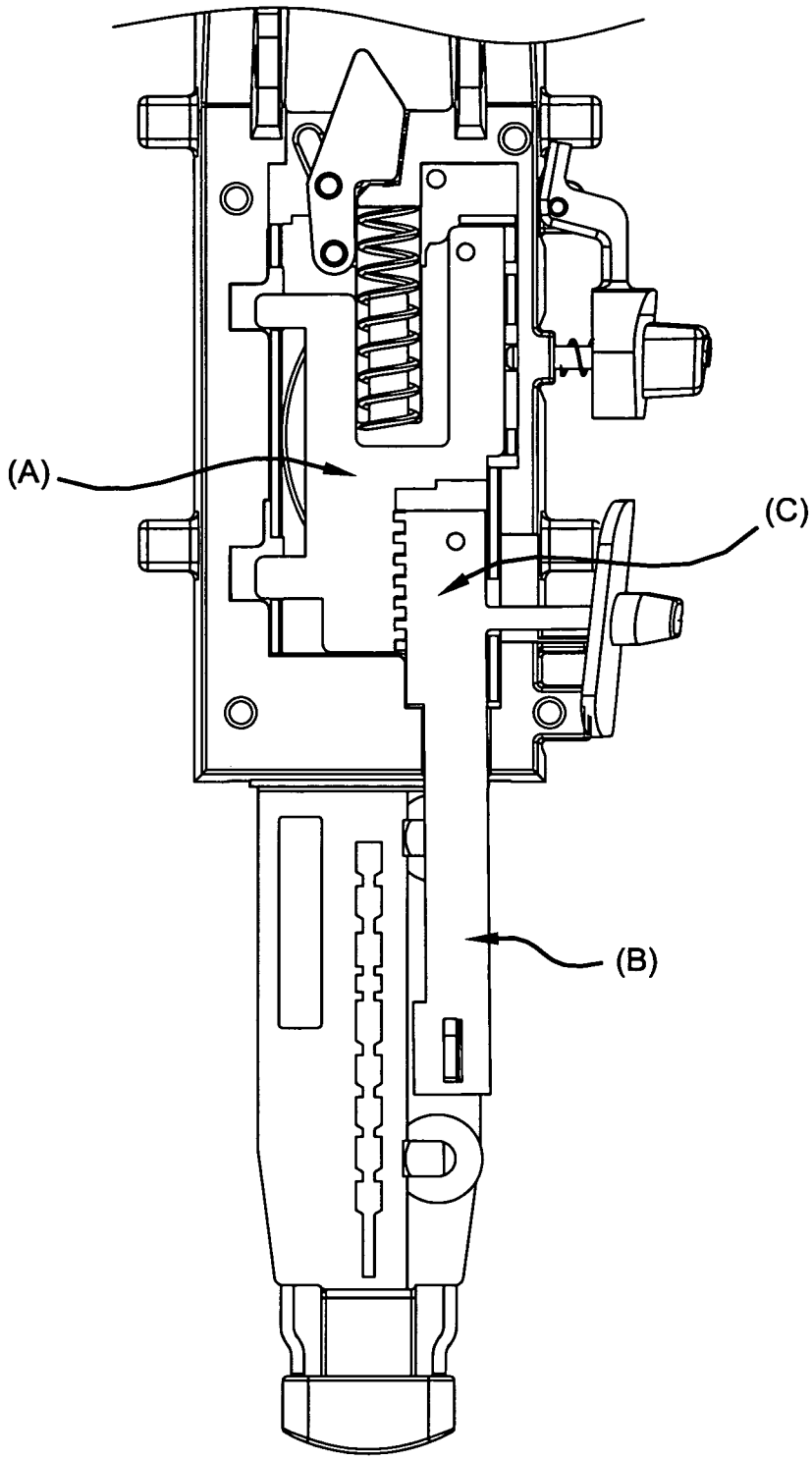
Figure 3A PRIOR ART
FIG. 3A is a prior art front view of a depth adjustment mechanism having a two piece configuration that can be separated to be elongated or shortened and coupled back together to adjust the depth at which the fastener is inserted into the workpiece.

In FIG. 3A and as shown in above-disclosed commonly assigned U.S. patent application Ser. No. 10/978,866 titled Operational Lock and Depth Adjustment for Fastening Tool, a depth adjustment mechanism (A) is integral to a contact trip mechanism (B). The depth adjustment mechanism (A) includes a two-piece assembly (C) that may be separated and lengthened or shortened to adjust a depth adjustment of a fastening tool.

Figure 3B:
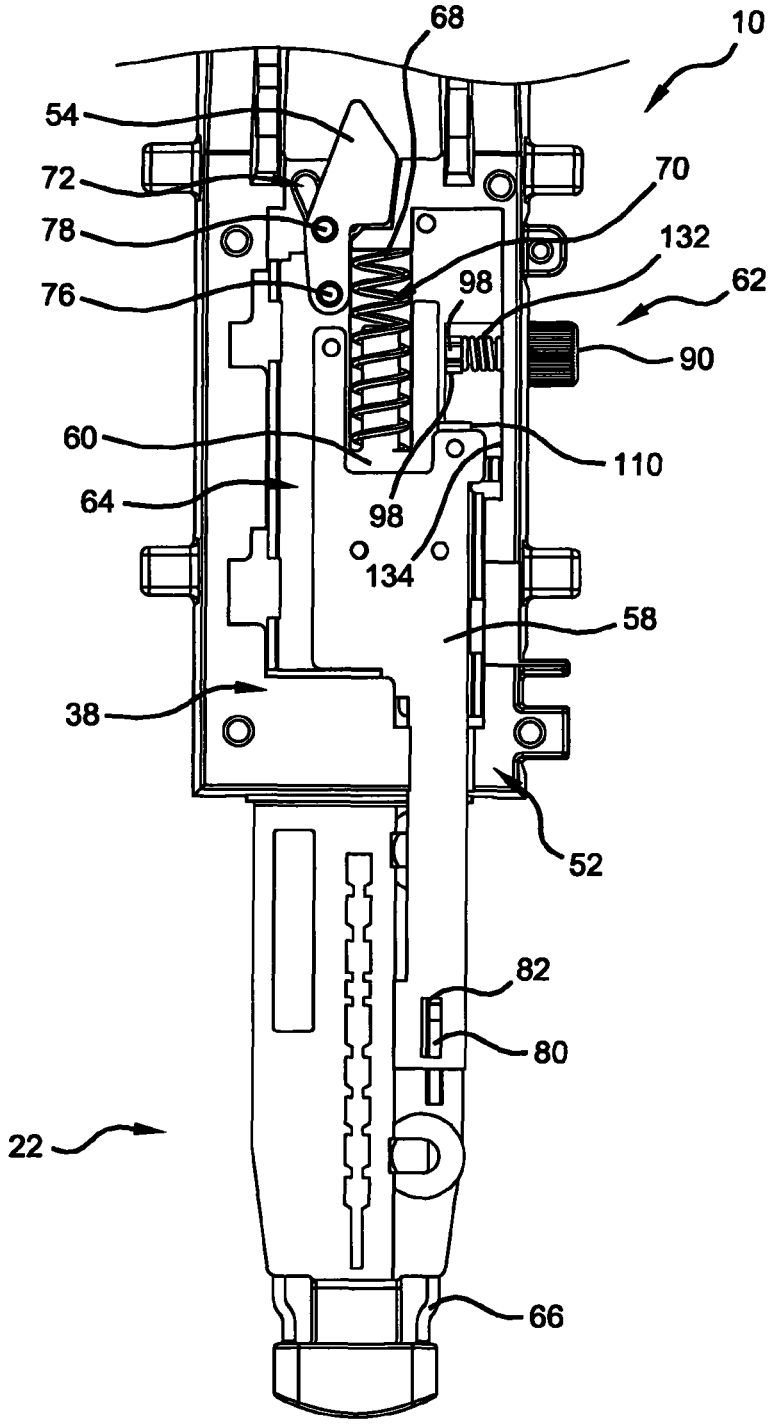
FIG. 3B is a partial front view of a depth adjustment mechanism shown integral with a contact trip mechanism and in an extended condition in accordance with the present teachings.
Figure 3C:
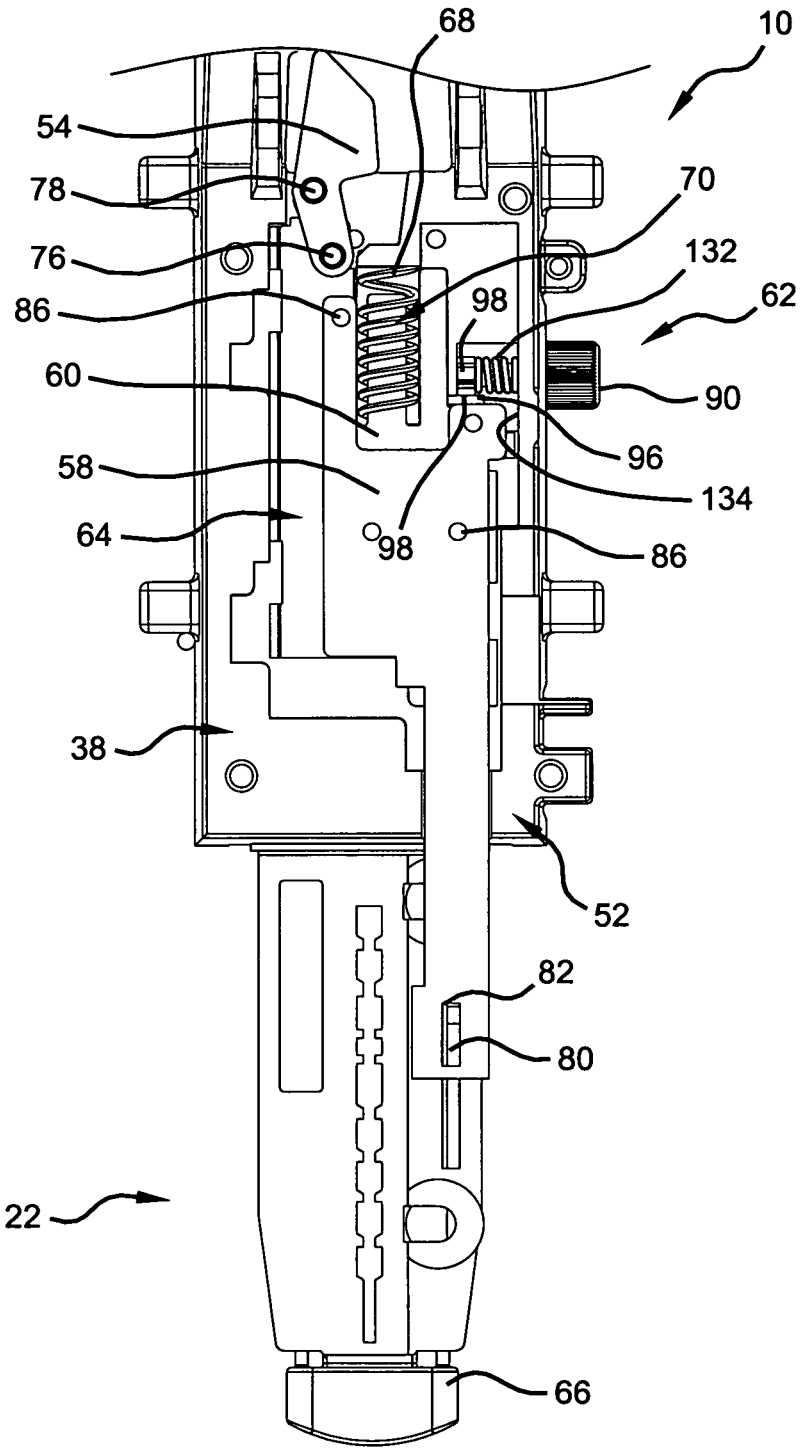
FIG. 3C is similar to FIG. 3B and shows the contact trip mechanism in a retracted position.
Figure 8A:
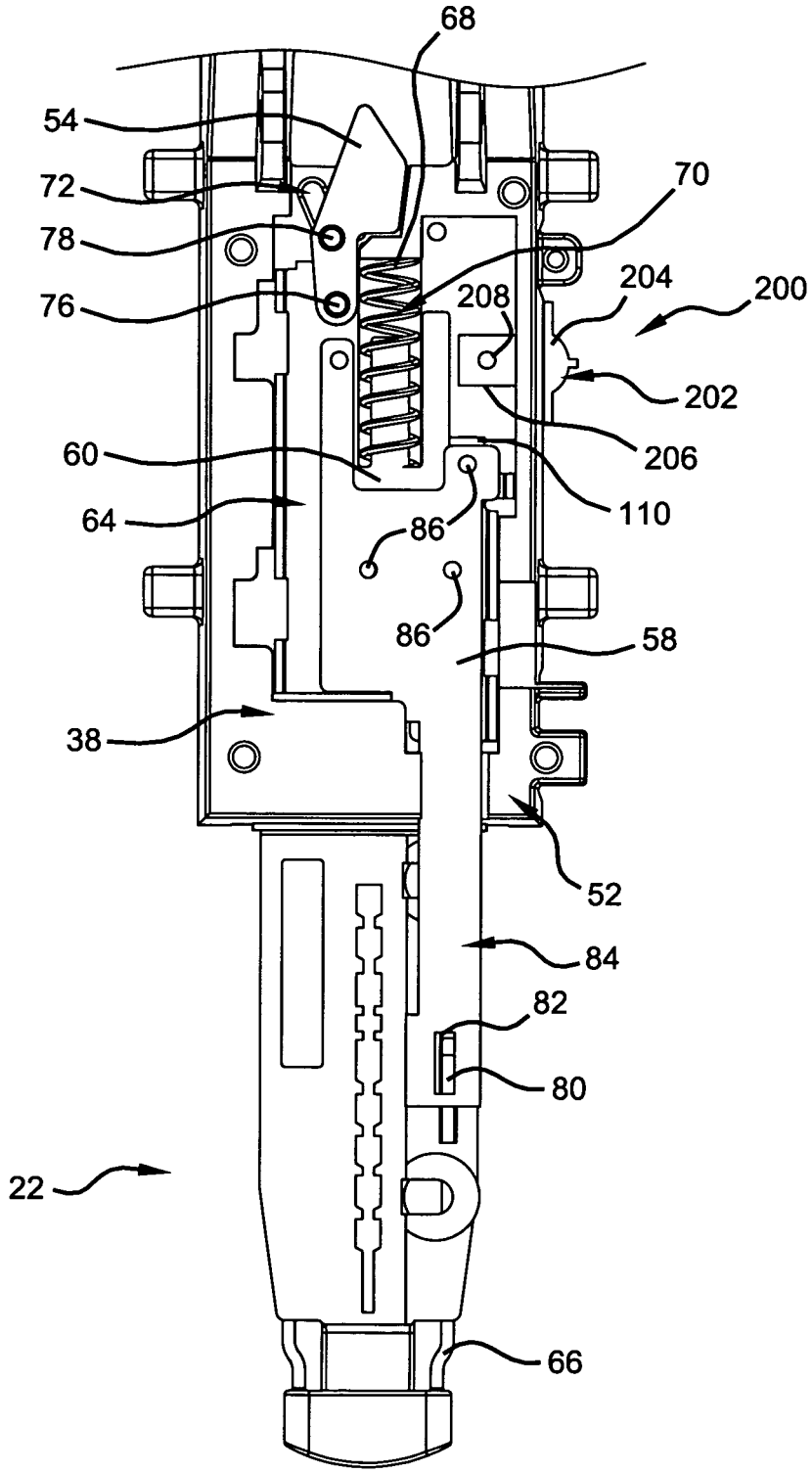
FIG. 8A shows a depth adjustment mechanism integral to a contact trip mechanism in accordance with another aspect of the present teachings, the contact trip mechanism is shown in an extended condition.
Figure 8B:
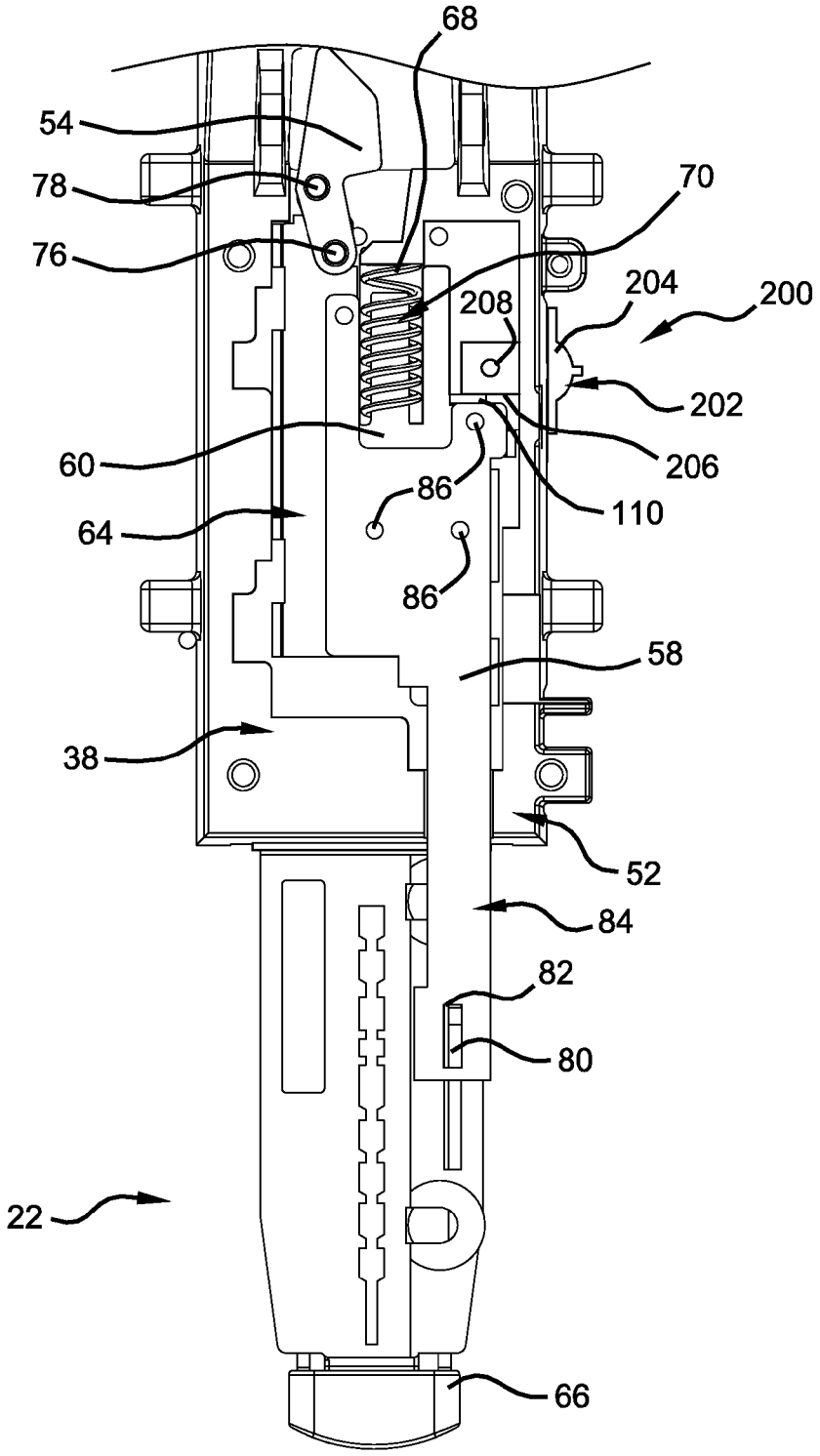
FIG. 8B is similar to FIG. 8A and shows the contact trip mechanism in a retracted condition.
Figure 9:
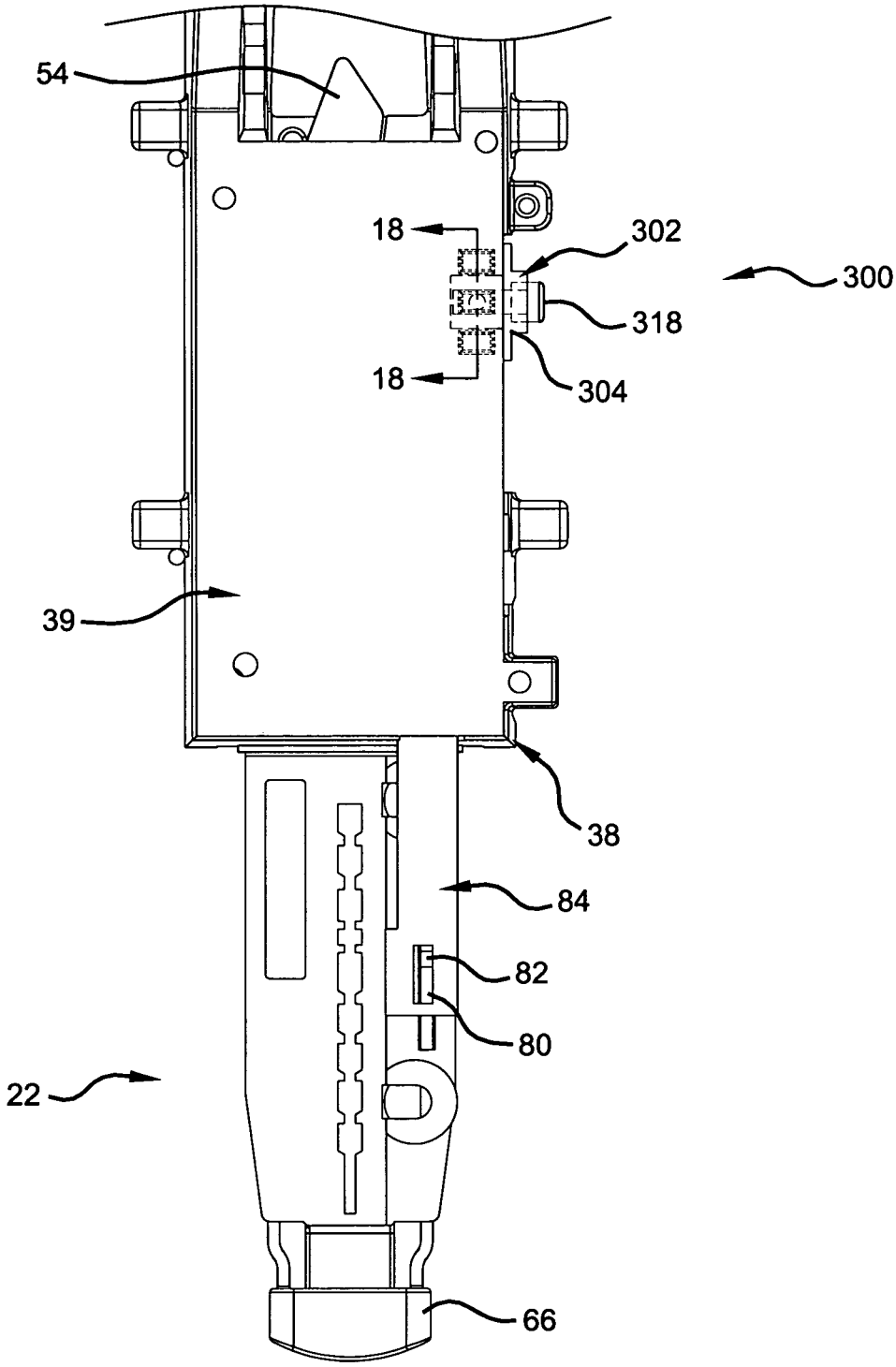
FIG. 9 shows a depth adjustment mechanism in accordance with a further aspect of the present teachings, the depth adjustment mechanism is configured to index against a transmission housing cover.

In accordance with the various aspects of the present teachings and with reference to FIGS. 3B and 8A, the above-disclosed two-piece assembly (C) (FIG. 3A) is omitted in lieu of a slider member 58, a carrier member 60 and a depth adjustment mechanism 62 (FIG. 3B), 62*a* (FIG. 16), 62*b* (FIG. 14), 62*c* (FIG. 15), 62*d* (FIG. 17), 200 (FIG. 8A), 300 (FIG. 9). A portion of the depth adjustment mechanism 62, 200 may be configured to mechanically block (i.e., physically obstruct) the carrier member 60, as the contact trip mechanism 52 moves from the extended condition to the retracted condition (FIGS. 3C and 8B). The above depth adjustment mechanisms may obstruct the carrier member 60 at various positions (corresponding to various depth settings), but each of the positions still permit activation of the trigger assembly 28 because the contact trip mechanism 52 is in the retracted position.

Figure 4:
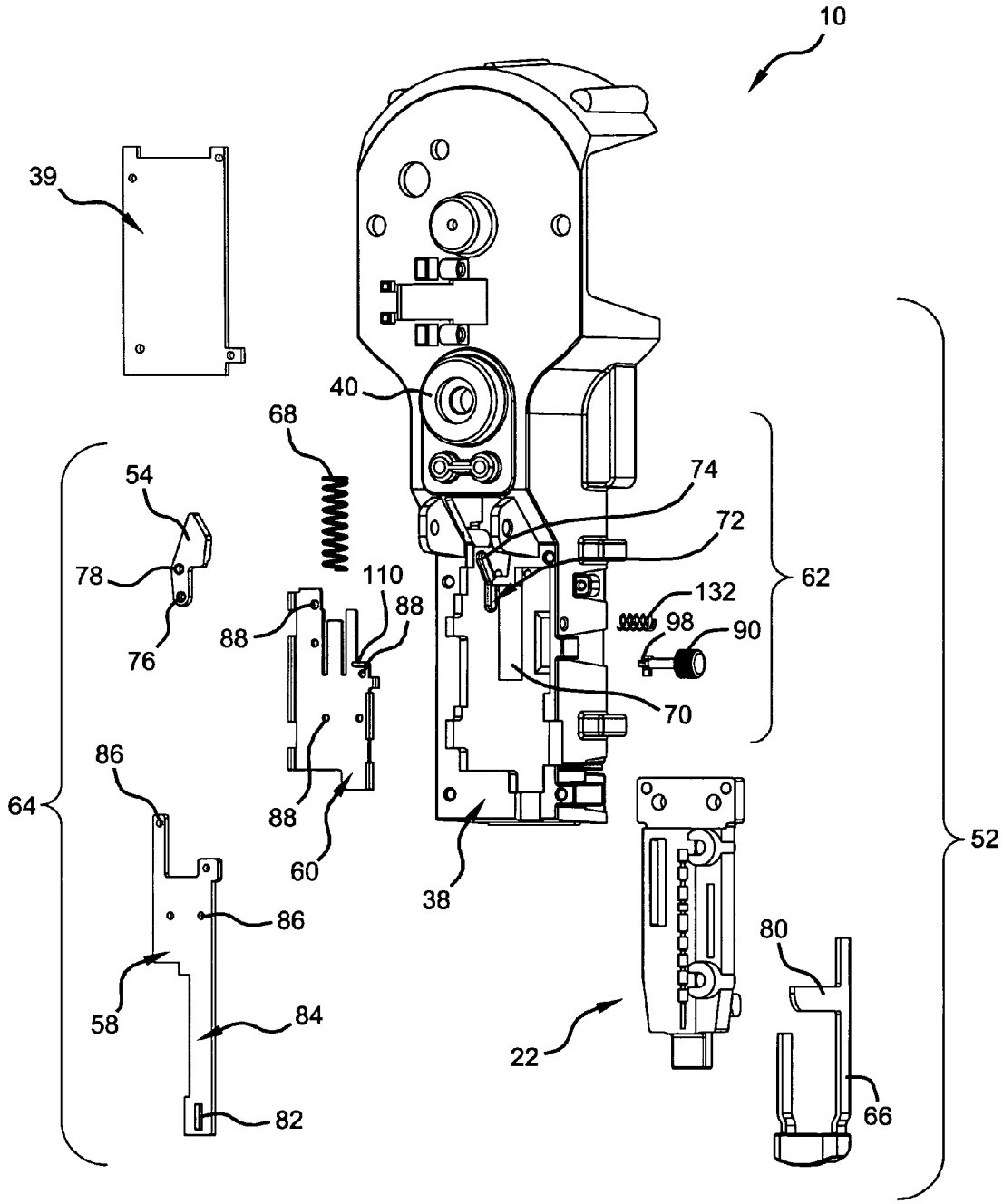
FIG. 4 is an exploded assembly view of a portion of the fastener tool shown in FIG. 1 and FIG. 2 showing a transmission housing and a depth adjustment mechanism having a rotatable depth adjuster member in accordance with the present teachings.
Figure 5:
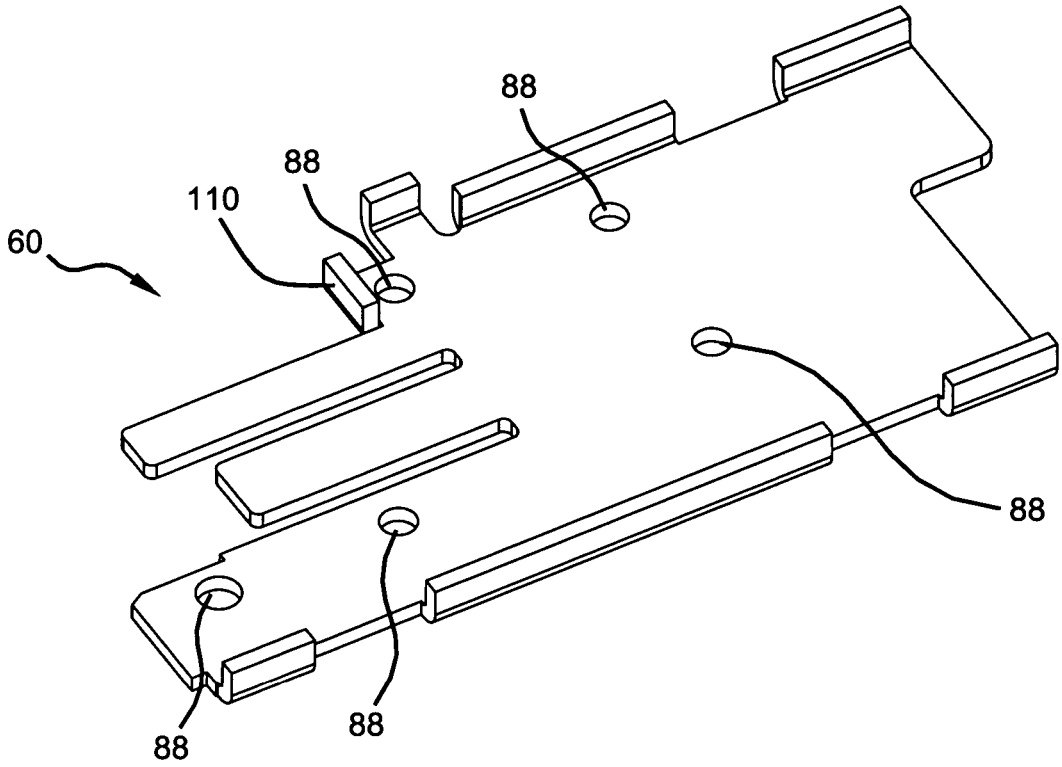
FIG. 5 is a perspective view of a carrier member of the depth adjustment mechanism of FIG. 4.

In one aspect of the present teachings and with reference to FIGS. 3B, 3C and 4, the contact trip mechanism 52 may include a multi-component mechanical linkage 64 that may connect the nosepiece 22 to the trigger assembly 28 (FIG. 2). The contact trip mechanism 52 may include a nose member 66 that may be a portion of the nosepiece 22 and may connect to the slider member 58. The slider member 58 may connect to the carrier member 60. The carrier member 60 may connect to the blocking member 54. A portion of the carrier member 60 may reside within a contact trip spring 68, both of which may reside in a portion of a carrier depression 70 formed in the transmission housing 38.

When the contact trip mechanism 52 is engaged against the workpiece 32 (FIG. 1), the contact trip mechanism 52 is positioned in the retracted position, as shown in FIG. 3C. In the retracted position, the nose member 66, the slider member 58 and the carrier member 60 as an assembly may move up, i.e., toward the transmission 16 (FIG. 2). As the carrier member 60 moves up, the blocking member 54 may travel in a channel 72 that may be formed in the transmission housing 38. The channel 72 may have a cam profile 74. The blocking member 54 may travel in the channel 72 between a blocked position (FIG. 3B) and an unblocked position (FIG. 3C). In this regard, the blocking member 54 may have a first pin 76 and a second pin 78. The first pin 76 may couple the blocking member 54 to the carrier member 60 and may permit the blocking member 54 to pivot relative to the carrier member 60. The second pin 78 may extend into the channel 72 and may travel along the cam profile 74 formed therein. By following the cam profile 74, the second pin 78 urges the blocking member 54 between the blocked position (FIG. 3B) and the unblocked position (FIG. 3C).

The nose member 66 may include a flange 80 that may extend generally perpendicular to the remaining portions of the nose member 66 (i.e., outward from the page in FIG. 3B). The flange 80 may be received by an aperture 82 formed on a lower portion 84 of the slider member 58. The lower portion 84 may extend from the transmission housing 38. The slider member 58 may include pins 86 that may extend through the slider member 58 and into apertures 88 formed in the carrier member 60, thus coupling the slider member 58 to the carrier member 60.

The contact trip spring 68 may be seated around a portion of the carrier member 60 and may be disposed in the carrier depression 70. The contact trip spring 68 may bias the carrier member 60 and, therefore, the slider member 58 into the extended position (FIG. 3B). When the nosepiece 22 is pressed into the workpiece 32, the contact trip mechanism 52 may be moved into the retracted position (FIG. 3C) and may overcome a force exerted by the contact trip spring 68. When the fastening tool 10 is disengaged from the workpiece 32, the contact trip spring 68 may urge the contact trip mechanism 52 back to the extended position (FIG. 3B).

Figure 6A:
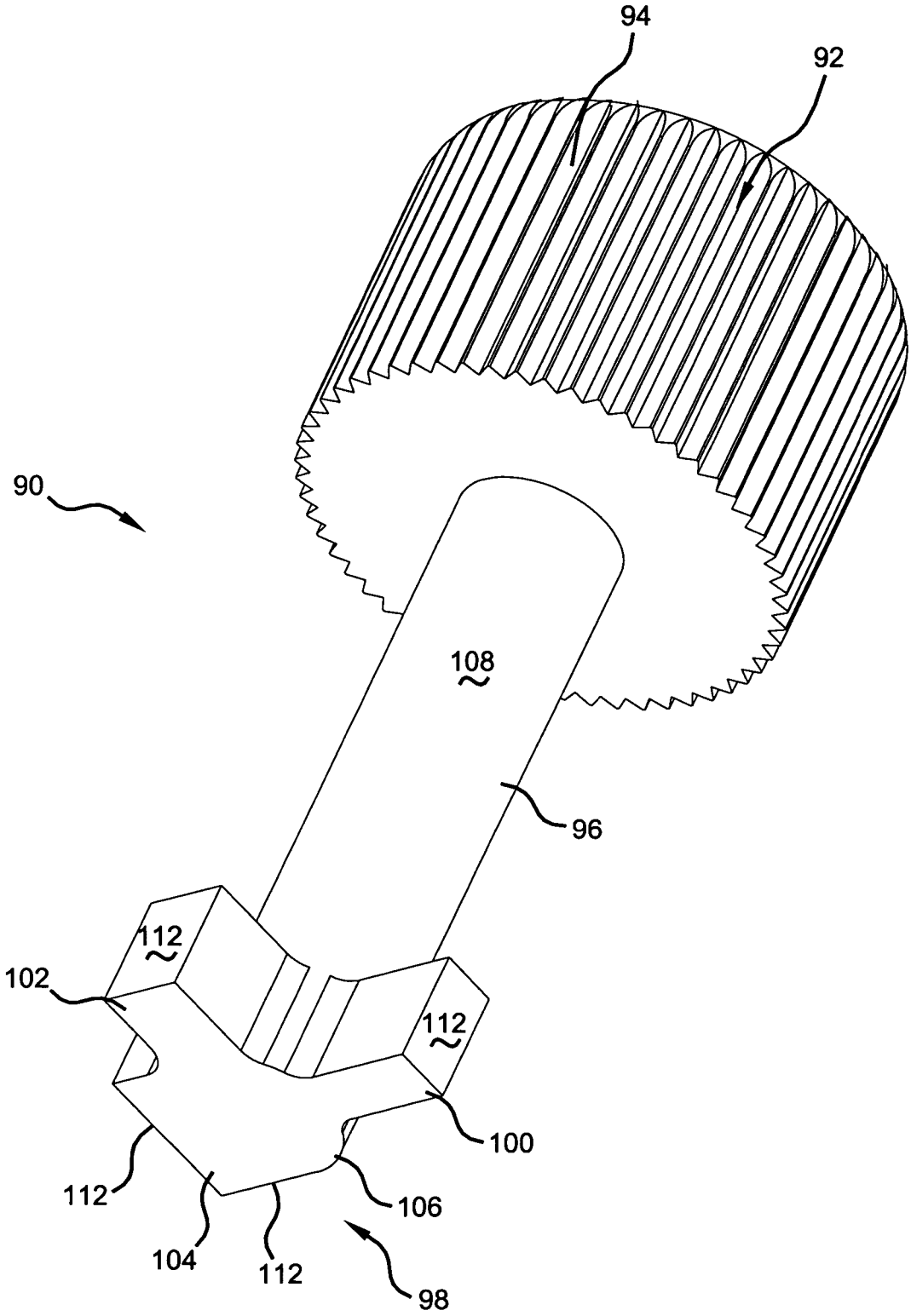
FIG. 6A is a perspective view of the rotatable depth adjuster member of the depth adjustment mechanism of FIG. 4.
Figure 6B:
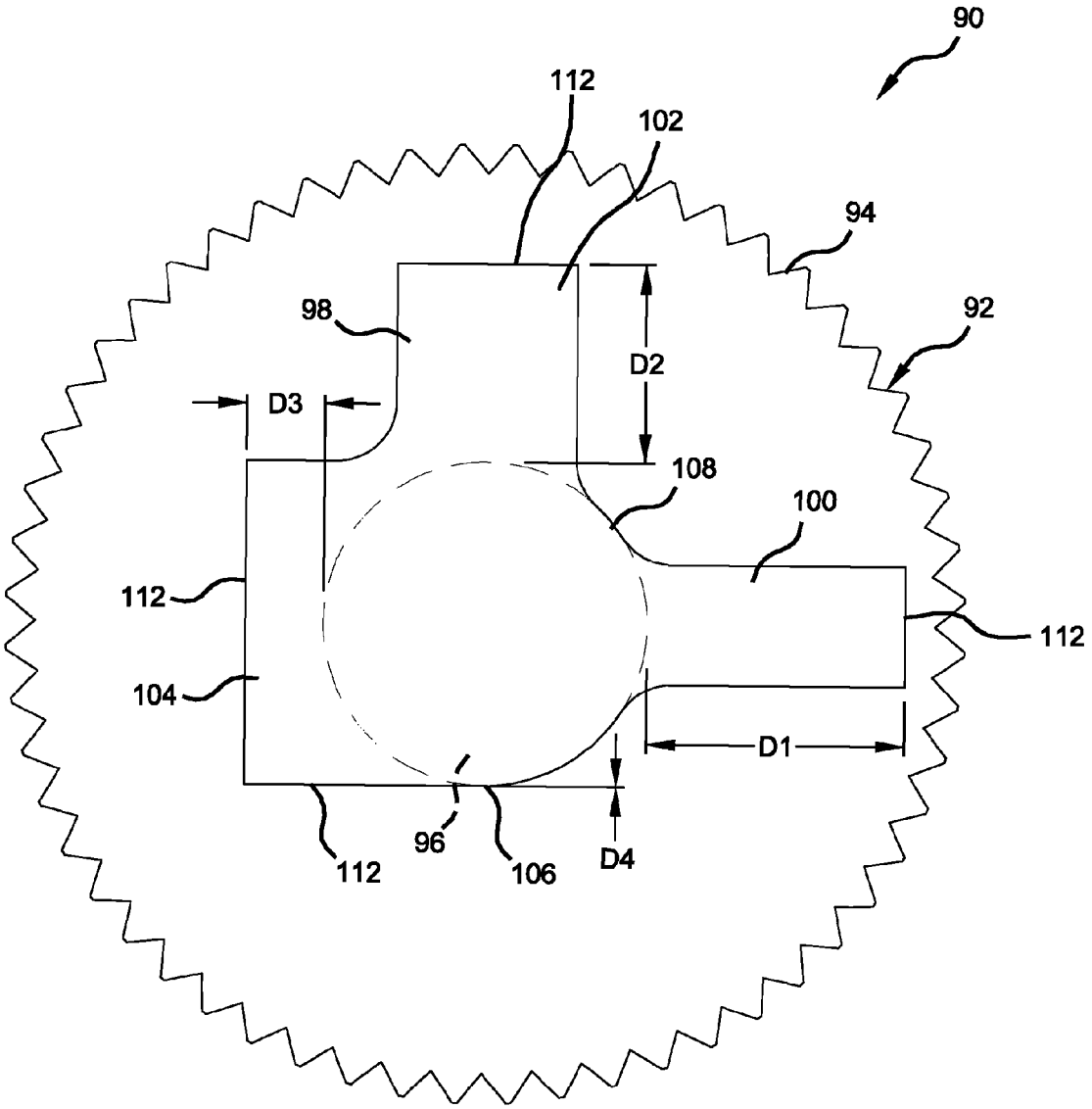
FIG. 6B is a front view of the rotatable depth adjuster member of FIG. 6A showing respective dimensions of cam blocks formed on a shaft of the adjuster member.

With reference to FIGS. 4, 6A and 6B, the depth adjustment mechanism 62 may include an adjuster member 90 having a round handle 92 that may have, for example, a knurled surface 94. A shaft 96 may extend from the round handle 92. A plurality of cam blocks 98 may be formed on the end of the shaft 96 opposite the handle 92. As illustrated, four cam blocks may extend from the shaft 96 at four associated positions. While the adjuster member 90 is illustrated with four cam blocks 98, it will be appreciated that additional cam blocks or less cam blocks may be used in accordance with various aspects of the present teachings.

In one aspect of the present teachings, a first cam block 100, a second cam block 102, a third cam block 104 and a fourth cam block 106 may extend from their associated positions on the shaft 96 and may be spaced from one another in generally ninety degree radial increments. In one aspect, the fourth cam block 106 may be a portion of an exterior face 108 of the shaft 96 (i.e., flush with the exterior face 108 of the shaft 96). In a further aspect not specifically illustrated, the fourth cam block 106 may extend from the exterior face 108 by a predetermined distance that is different from the three remaining cam blocks and thus provide for different depth adjustment settings. The adjuster member 90 may be rotated so that one of the cam blocks 98 may abut and thus obstruct a flange 110 that extends from the carrier member 60, as the contact trip mechanism 52 moves from the extended position (FIGS. 3B and 8A) to the retracted position (FIGS. 3C and 8B). The flange 110 may be an upturned portion of the carrier member 60.

It will be appreciated that the depth adjustment mechanism 62 (FIG. 3B), 62*a* (FIG. 16), 62*b* (FIG. 14), 62*c* (FIG. 15), 62*d* (FIG. 17), 200 (FIG. 8A), 300 (FIG. 9) and specifically the associated adjuster member 90 (FIG. 6A), 90*a* (FIG. 7A), 90*b* (FIG. 7B), 90*c* (FIG. 15), 90*d* (FIG. 17) may set a dimension corresponding to a distance that the nose member 66 translates until the carrier member 60 encounters the adjuster member 90 and, therefore, moves from the extended position to the retracted position. Regardless of depth adjustment setting (i.e., position of the above adjuster members), the contact trip mechanism 52 can be moved into the retracted position and can move the blocking member 54 into the unblocked position (FIGS. 3C and 8B).

With reference to FIG. 6B, each of the cam blocks 98 may have an abutment surface 112. The abutment surface 112 may be the surface with which the flange 110 of the carrier member 60 makes contact. Dimensions (D1, D2, D3, D4) may be defined between the respective abutment surface 112 of each cam block 98 and the exterior surface or face 108 of the shaft 96 from which each cam block 98 can extend. In one aspect of the present teachings, the dimension D4 is equal to zero. As such, the depth at which the fastener 30 (FIG. 1) is driven into the workpiece 32 (FIG. 1) may be based on the position of the adjuster member 90 and specifically the dimensions (D1, D2, D3, D4) between the exterior surface 108 of the shaft 96 and the abutment surfaces 112 of the cam blocks 98. In one aspect, the first cam block 100 may define the largest dimension Dl relative to the other dimensions (D2, D3, D4) associated with the other cam blocks 102, 104, 106 and may necessarily provide for the shallowest depth at which the fastener 30 can be driven into the workpiece 32.

The driving depth may be defined as a dimension between the head 114 of the fastener 30 and the surface 116 of the workpiece 32, as shown in FIG. 1. As such, the fourth cam block 106 on the shaft 96 may be associated with the largest driving depth.

Figure 7A:
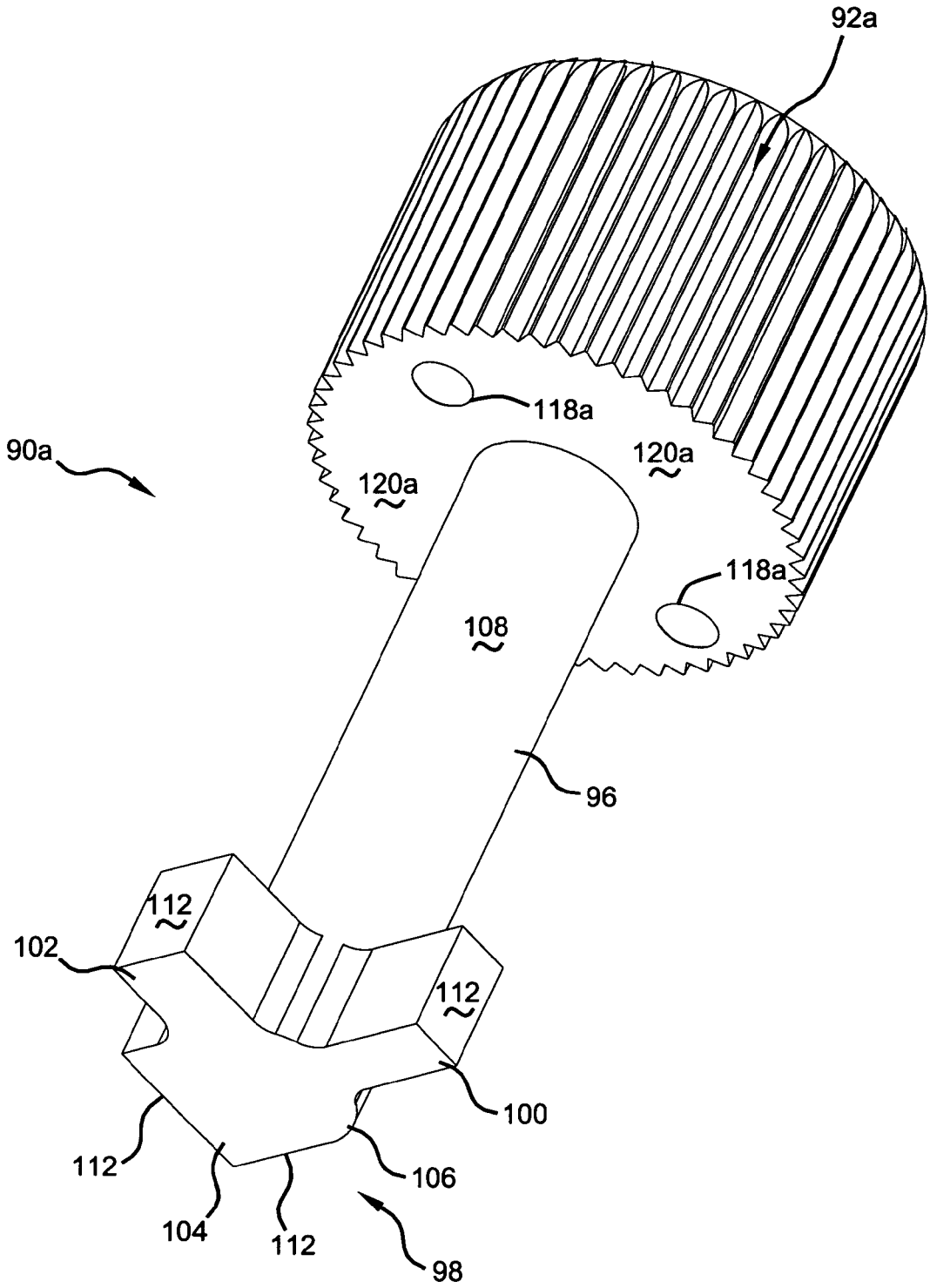
FIG. 7A is a perspective view of the rotatable depth adjuster member in accordance with another aspect of the present teachings.
Figure 7B:
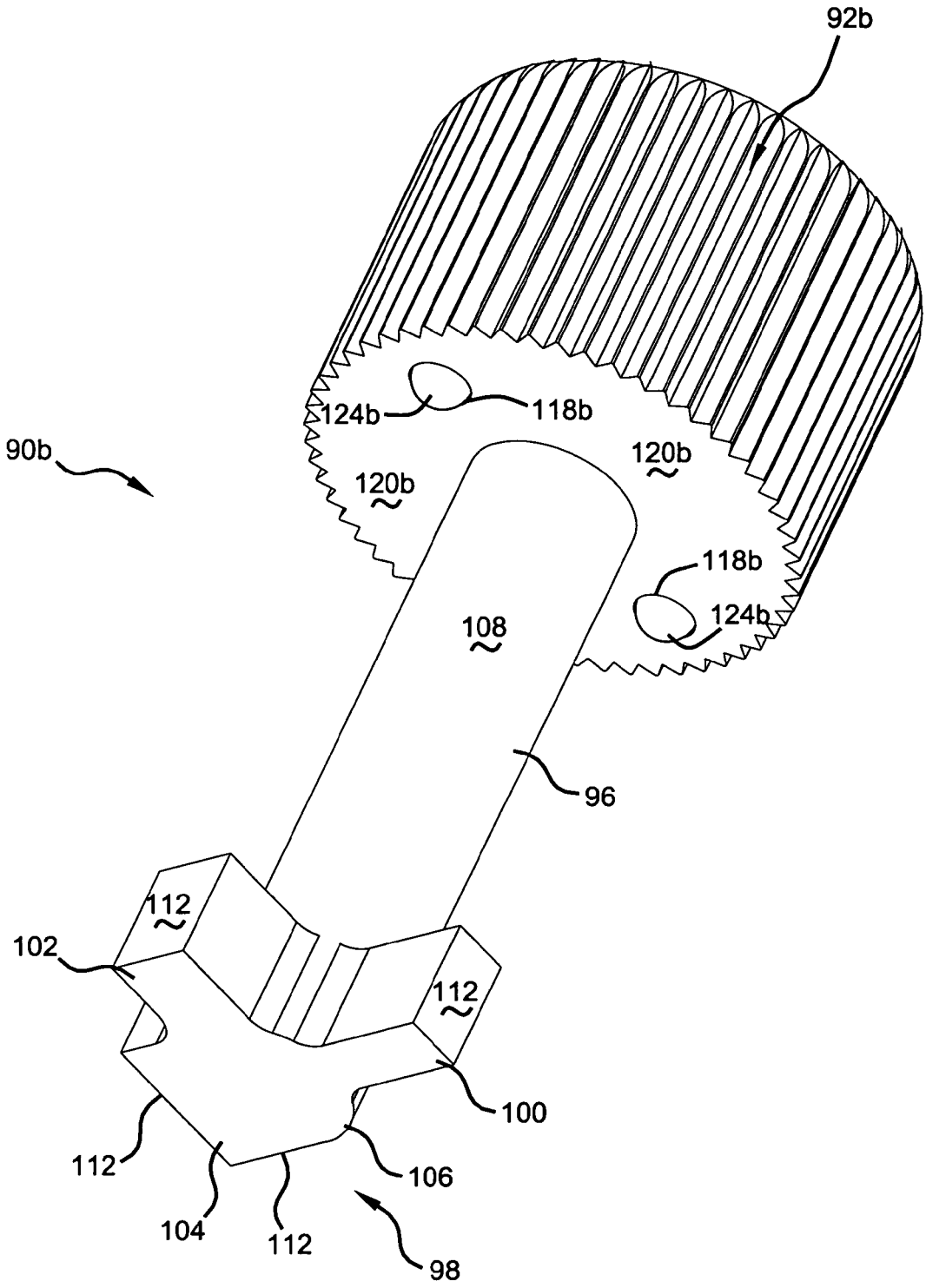
FIG. 7B is a perspective view of the rotatable depth adjuster member in accordance with a further aspect of the present teachings.
Figure 14:
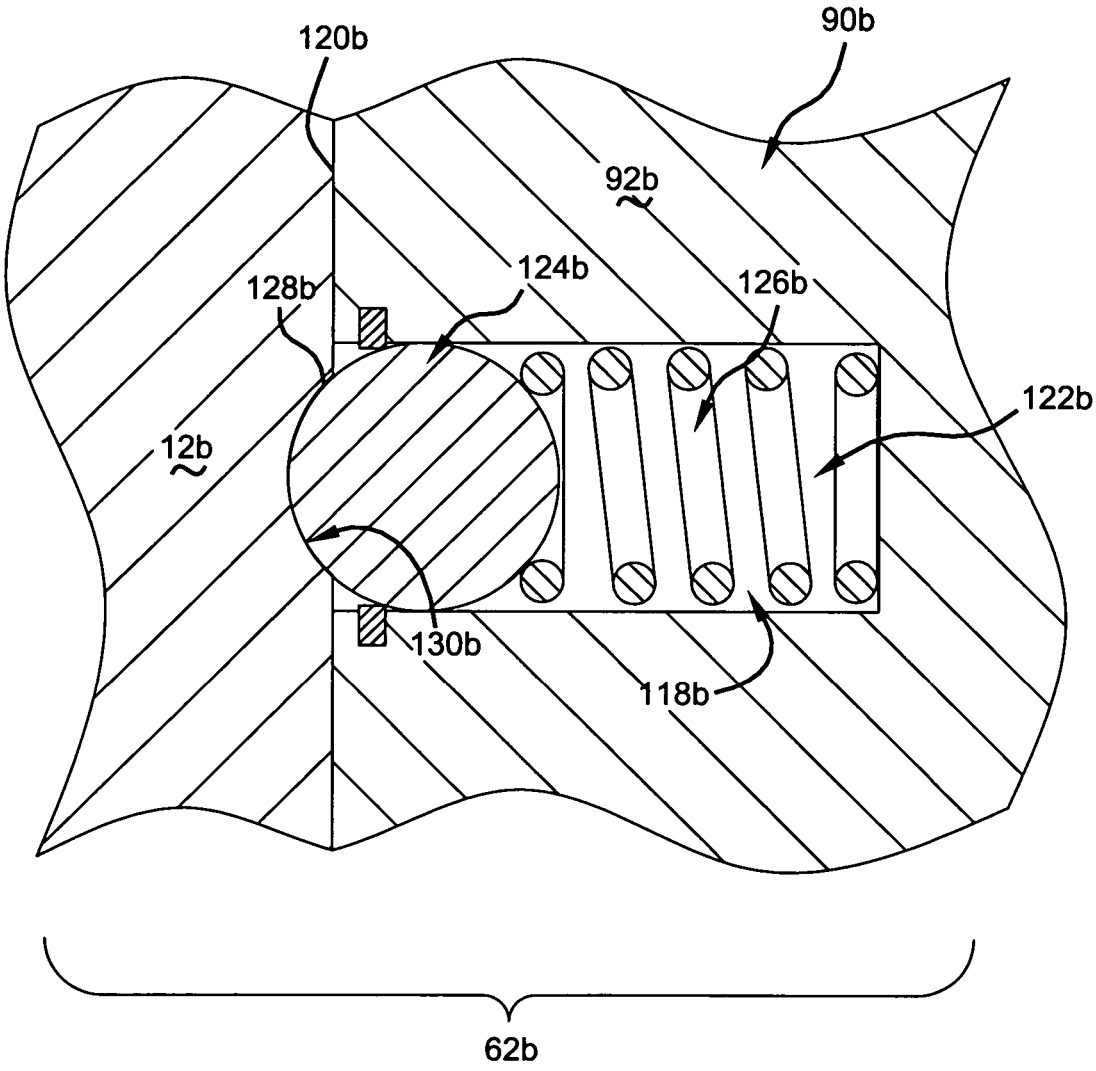
FIG. 14 is a diagram of a partial cross-sectional view of the adjuster member of FIG. 7B having a ball bearing and spring assembly that allows the adjuster member to index against an associated tool housing in accordance with another aspect of the present teachings.
Figure 16:
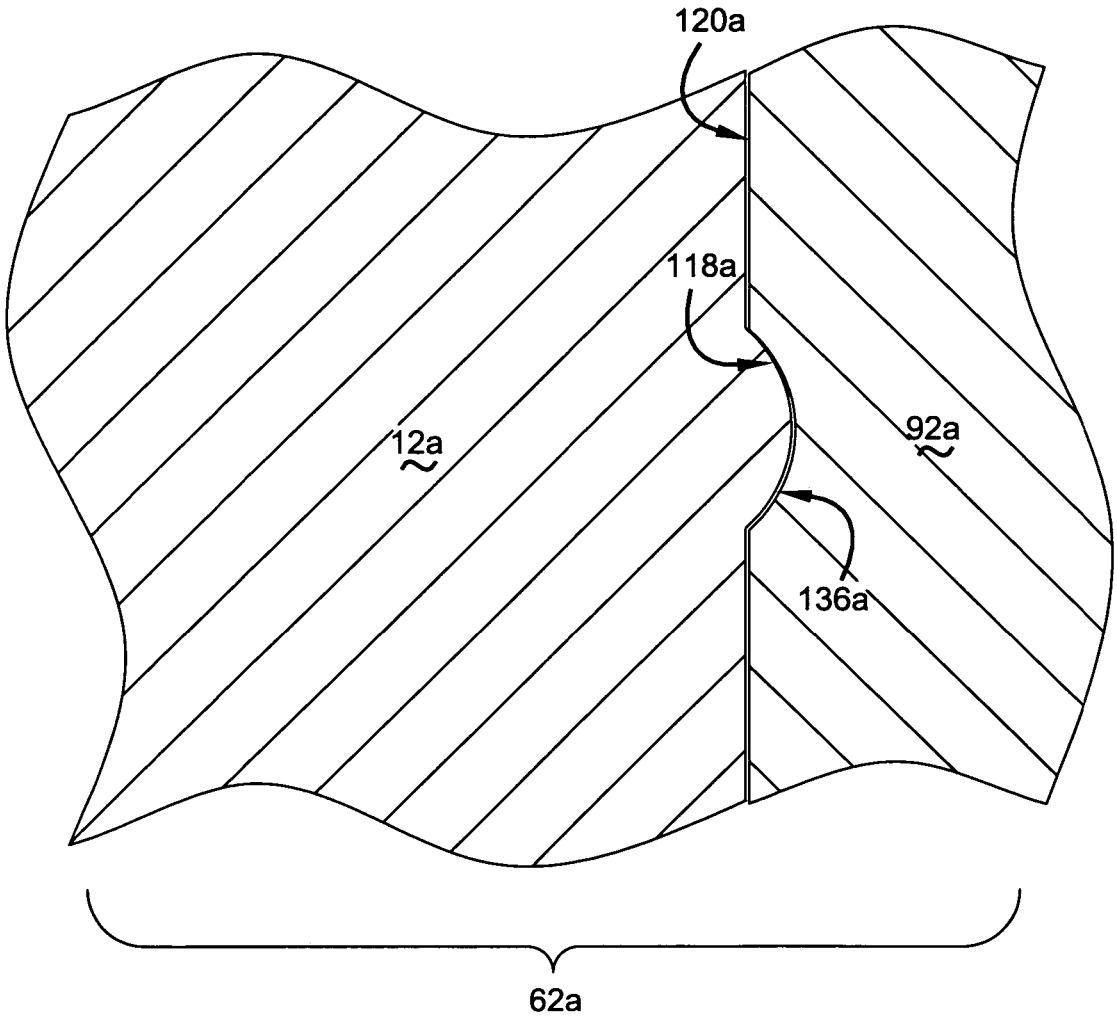
FIG. 16 is a diagram of a partial cross-sectional view of the adjuster member of FIG. 7A having an aperture that allows the adjuster member to index against an associated tool housing in accordance with another aspect of the present teachings.

In another aspect of the present teachings and with reference to FIGS. 7A and 16, a depth adjustment mechanism 62*a* can include an adjuster member 90*a* that can have apertures 118*a* formed on a back surface 120*a* of the handle 92*a*. In a further aspect of the present teachings and with reference to FIGS. 7B and 14, a depth adjustment mechanism 62*b* can include an adjuster member 90*b* that can have apertures 118*b* formed on the back surface 120*b* of the handle 92*b*. The apertures 118*b* may accept a ball bearing and spring assembly 122*b*. With reference to FIG. 14, a ball bearing 124*b* may be urged by a spring 126*b* so that a face 128*b* of the ball bearing 124*b* may be exposed and may be received by an aperture 130*b* formed on the tool housing 12*b*. As the adjuster member 90*b* is rotated, the ball bearing 124*b* may be urged into its respective aperture 118*b* until the adjuster member 90*b* can rotate to its next position. In the next position (not specifically shown), the ball bearing 124*b* again extends from the aperture 118*b* and may be received by another aperture (not specifically shown) formed on the tool housing 12*b*. In this regard, the adjuster member 90*b* may be releasably held in place (i.e., index) against the tool housing 12*b* at each depth setting, which corresponds to each position of the adjuster member 90*b*.

Figure 15:
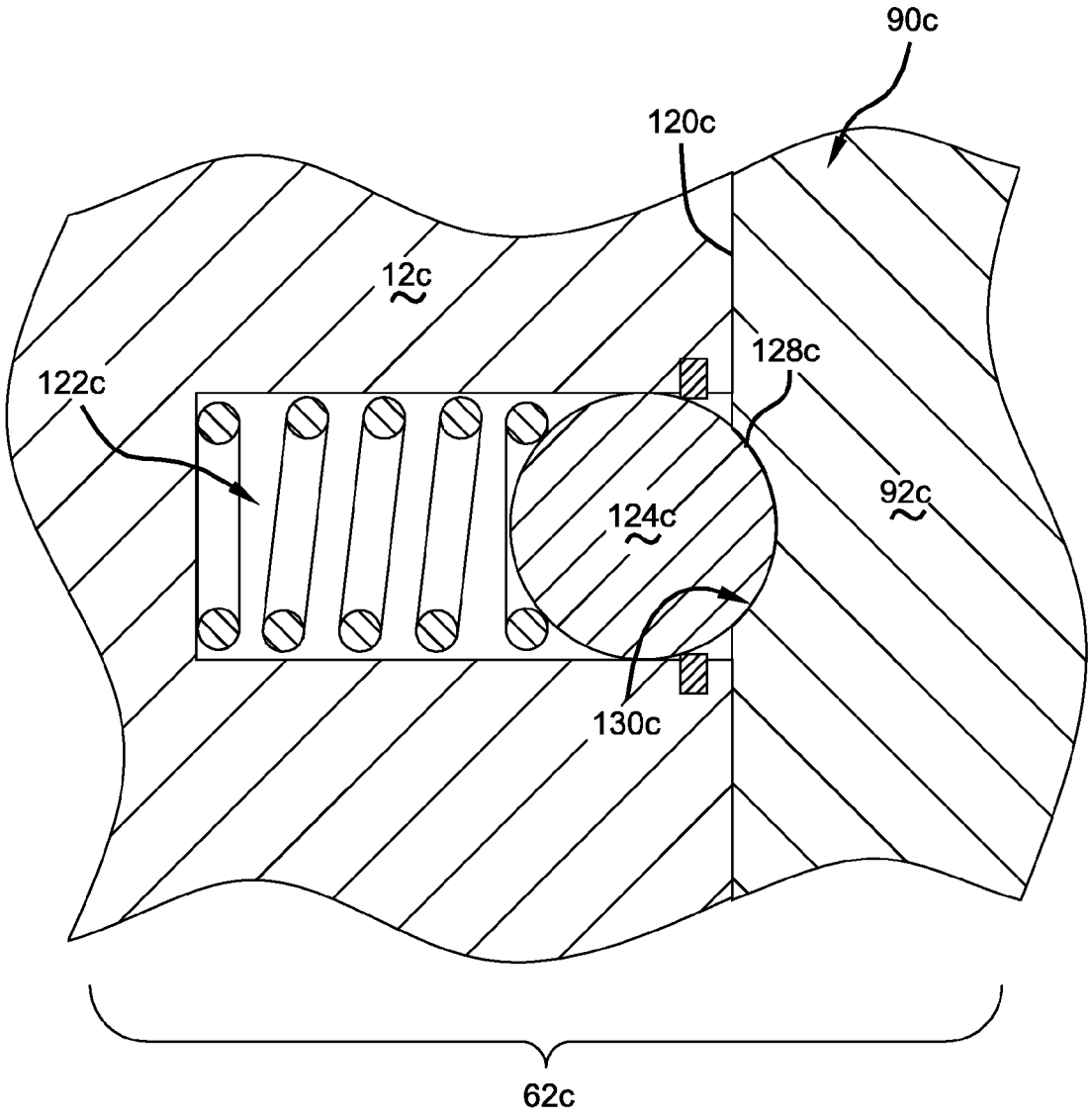
FIG. 15 is similar to FIG. 14 and shows the tool housing containing the ball bearing and spring assembly in accordance with a further aspect of the present teachings.

In a further aspect of the present teachings and with reference to FIG. 15, a depth adjustment mechanism 62*c* can include a ball bearing and spring assembly 122*c* that can be contained within a portion of the tool housing 12*c*, rather than the adjuster member 90*b*, as shown in FIG. 14. In this regard, the depth adjustment mechanism 62*c* can include an aperture 130*c* that may be formed on a back surface 120*c* of the handle 92*c*. The aperture 130*c* may accept the face 128*c* of the ball bearing 124*c*. Similar to what is illustrated in FIG. 14, the adjuster member 90*c* may rotate between positions and the ball bearing and spring assembly 122*c* may hold the adjuster member 90*c* in position, as the ball bearing 124*c* is accepted by each aperture 130*c*.

With reference to FIGS. 14 and 15, it will be appreciated that the amount of apertures 118*b* or 130*c* may correspond to the amount of depth setting positions that are configured on the adjuster member 90*b*, 90*c*. Whether the ball bearing and spring assembly 122*b*, 122*c* is contained within the tool housing 12*c* or contained within the adjuster member 90*b*, the various aspects of the present teachings allow the adjuster member 90, 90*a*, 90*b*, 90*c*, 90*d* to be indexed against the tool housing 12, 12*a*, 12*b*, 12*c*, 12*d*, as applicable In another aspect and with reference to FIGS. 3B and 3C, a spring 132 may be disposed between the cam blocks 98 and an adjacent surface 134 of the transmission housing 38. The spring 132 may bias the adjuster member 90 in toward the tool housing 12 (i.e., toward the spring 68 and the carrier depression 70). By doing so, the back surface 120 of the handle 92 may be held in an abutting relationship with the tool housing 12. The fit of the handle 92 in the tool housing 12 may hold or index the adjuster member 90 in the various positions that correspond to the depth adjustment settings.

With reference to FIGS. 7A and 16, the aperture 118*a* formed on the back surface 120*a* of the handle 92*a* may receive a protrusion 136*a* formed on the tool housing 12*a*. As the adjuster member 90*a* is rotated, the handle 92*a* may travel slightly away from the tool housing 12*a* (rightward relative to FIGS. 3B and 16) thus compressing the spring 132 (FIG. 3B). The aperture 118*a* formed on the back surface 120*a* of the handle 92*a* may skip over the protrusion 136*a* formed on the tool housing 12*a*. As the adjuster member 90*a* rotates to a next position, the spring 132 may pull the adjuster member back toward the tool housing 12*a* so that the protrusion 136*a* is received by the aperture 118*a*.

The protrusion 136*a* in cooperation with the aperture 118*a* may hold the adjuster member 90*a* in position, similar to that of the ball bearing and spring assembly 122*b*, 122*c*, as illustrated in FIGS. 14 and 15. In this regard, the engagement of the aperture 118*a* by the protrusion 136*a* allows for indexing of the adjuster member 90*a* against the tool housing 12*a*. For example, the handle 92*a* may turn and click (i.e., index) into a position associated with a depth setting and one of the abutment surfaces 112 of the cam blocks 98 so that the abutment surface is generally aligned with and therefore positioned to abut the flange 110 on the carrier member 60.

Figure 17:
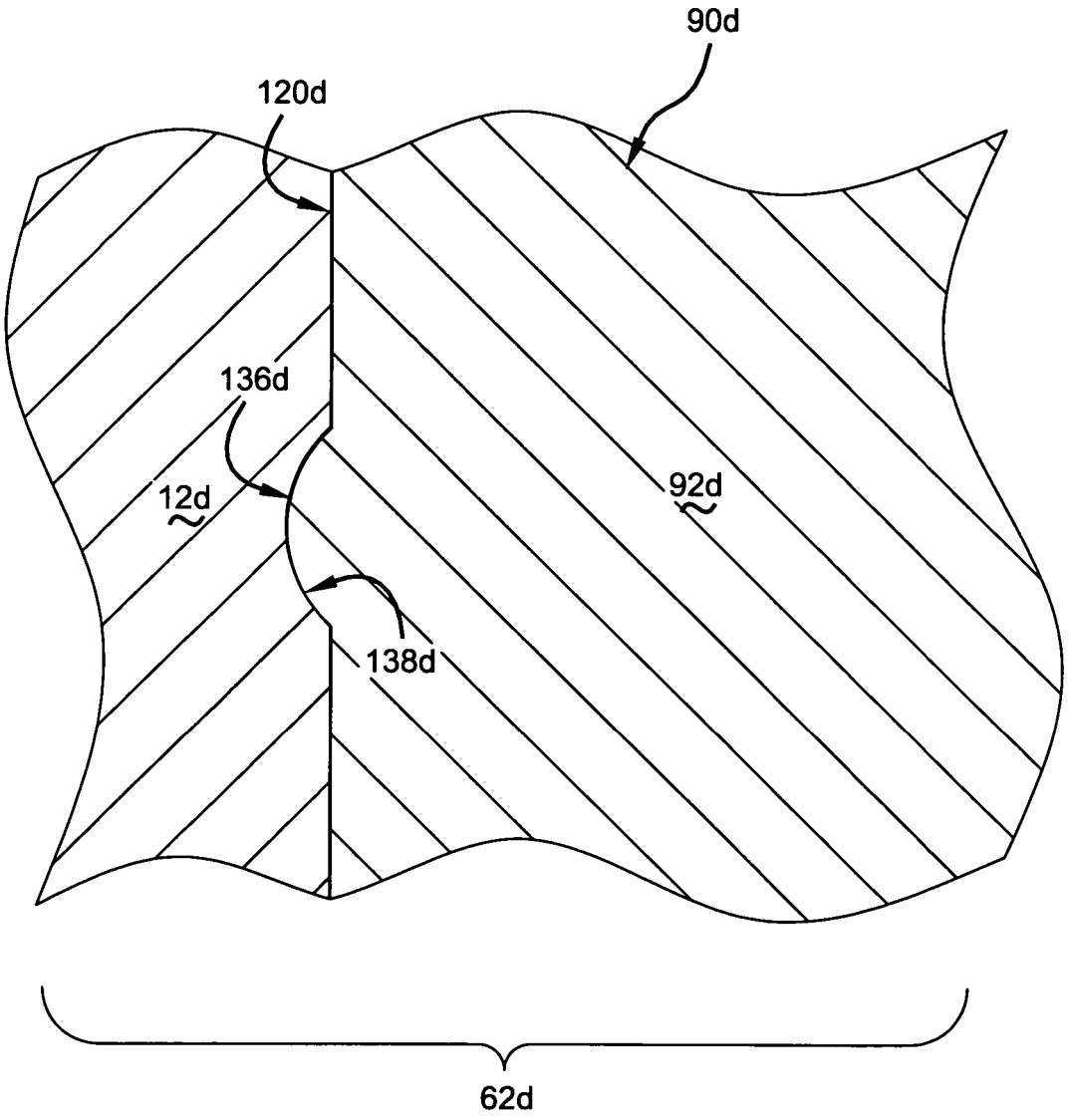
FIG. 17 is similar to FIG. 16 and shows the tool housing containing the aperture in accordance with a further aspect of the present teachings.

In accordance with a further aspect of the present teachings and with reference to FIG. 17, a depth adjustment mechanism 62*d* can include the protrusion 136*d* that can be formed on the back surface 120*d* of the handle 92*d* rather than the tool housing 12*a*, as shown in FIG. 16. In this regard, an aperture 138*d* may be formed on the tool housing 12*d*. Similar to the protrusion 136*a* and the aperture 118*a*, as illustrated in FIG. 16, the protrusion 136*d* and the respective aperture 138*d* may allow the handle 92*d* to index against the tool housing 12*d*.

In additional aspects of the present teachings, the manual depth adjustment mechanism 62, 62*a*, 62*b*, 62*c*, 62*d* can be substituted for an electromechanical mechanism. Push buttons each associated with a depth position or a keypad and a display pad may be used to enter a desired position of the cam blocks (not specifically shown). A motor coupled to the shaft (directly or indirectly) may rotate the shaft to adjust the position of the cam blocks and the depth setting accordingly.

In another aspect of the present teachings and with reference to FIGS. 8A-10, a sliding selector mechanism 200 may be substituted for the adjuster member 90 of FIG. 3B. The sliding selector mechanism 200 may include an adjuster member 202 that may be configured to be movable to three positions relative to the tool housing 12. It will be appreciated that two, four or any other number of positions are possible that may correlate with driving depth settings in accordance with the present teachings. In that regard, the adjuster member 202 may similarly index against the tool housing 12 between positions that corresponds selected driving depths. As such, the adjuster member 202 may utilize a ball and spring assembly 122 (FIG. 11), which can be similar to the ball and spring assembly 122*b* (FIG. 14) and the ball and spring assembly 122*c* (FIG. 15) or something similar to the apertures 118*a*, 138*d* and protrusions 136*a*, 136*d* (FIGS. 16 and 17) or combinations thereof.

Figure 11:
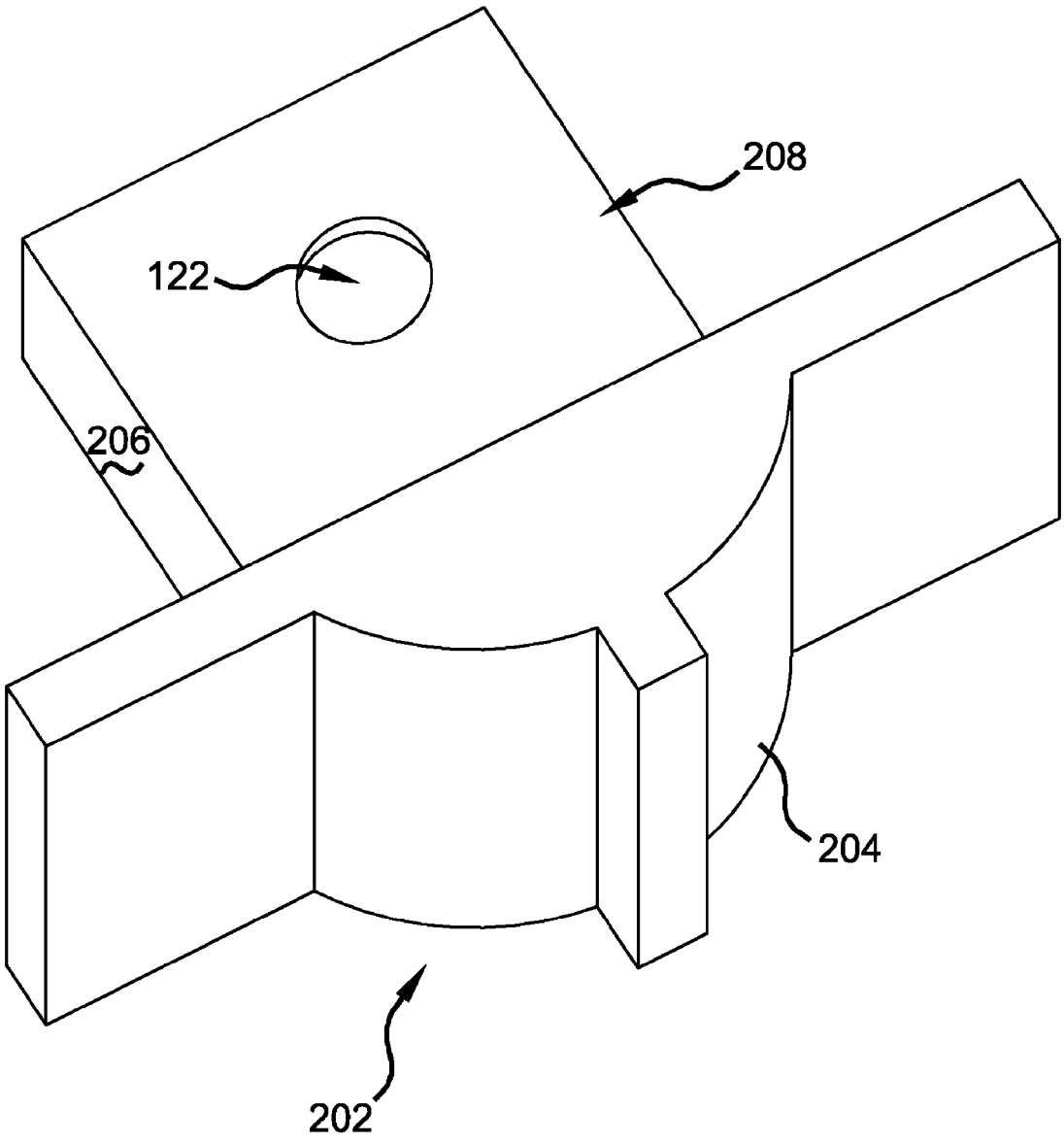
FIG. 11 shows a perspective view of a sliding adjuster member of the depth adjustment mechanism of FIG. 8A.

With reference to FIGS. 8A and 11, a handle 204 of the adjuster member 202 may be pushed (pulled, etc.) up or down, as the adjuster member 202 is indexed against the tool housing 12. In this regard, an abutment surface 206 on a blocking portion 208 may be positioned to similarly abut, (i.e., physical obstruct) the flange 110 on the carrier member 60, as the contact trip mechanism 52 is moved from the extended position (FIG. 8A) to the retracted position (FIG. 8B). The adjuster member 202 may be moved into a first position, which correlates with the shallowest depth position, as described above. The shallowest depth adjustment position corresponds with the handle 204 being at its bottommost position (i.e., toward the nosepiece 22). The adjuster member 202 may be moved upward (i.e., away from the nosepiece 22) into additional positions that may correlate with larger driving depth settings (relative to the bottommost position).

Like the adjuster member 90 (FIG. 3B), the adjuster member 202 physically obstructs the flange 110 on the carrier member 60 so that positions of the adjuster member 202 may correspond to certain driving depth settings. Nevertheless, all of the positions of the adjuster member 202 allow the blocking member 54 to move to the unblocked position that is associated with the contact trip mechanism 52 being in the retracted position, as shown in FIG. 8B. Like the adjuster member 90 (FIG. 3B), the adjuster member 202 may be integrated with an electromechanical system such that up or down toggles, push buttons or the like. The electromechanical system may be implemented to control a motor that may move the adjuster member 202 to the various above disclosed positions to abut the carrier member 60 associated with the certain driving depths (not specifically shown).

In a further aspect of the present teachings and with reference to FIGS. 9, 12, 13A and 13B, an adjuster member 300 may index against a transmission housing cover 39 (FIG. 10) that releasably connects to the transmission housing 38. The adjuster member 300 may be releasably held in positions that are similar to the above disclosed positions that are associated with the certain driving depth settings.

The adjuster member 300 can have a member body 302 that can have two portions: An exterior portion 304 and an interior portion 306, the terms interior and exterior being relative to the tool housing 12. A pathway 308 may be formed through the member body 302. A first opening 310 of the pathway 308 may be on the exterior portion 304. A second opening 312 of the pathway 308 may be on the interior portion 306. A button member 314 and a post member 316 may be partially contained within the pathway 308.

The button member 314 may include a cap portion 318 and a shaft portion 320 that extends from the cap portion 318. The cap portion 318 may include a generally annular groove 322 formed on a back surface 324 of the cap portion 318 that can receive one end of a spring 326. The shaft portion 320 can extend from the cap portion 318 and through the spring 326. The shaft portion 320 can include an aperture 328 formed along the shaft portion 320. The cap portion 318 can be rounded or flat and may (or may not) include a textured surface.

The post member 316 may have a head portion 330 and a shaft portion 332 that extends from the head portion 330. The head portion 330 may be rounded or flat and may (or may not) include a textured surface. An annular flange 334 may be formed in a portion of the pathway 308 associated with the post member 316. A spring 336 may be disposed between a back surface 338 of the head portion 330 and the annular flange 334. The shaft portion 332 may extend through the spring 336. An end 340 of the shaft portion 332 that is opposite the head portion 330 can extend beyond the annular flange 334 and can be held by the aperture 328 formed in the shaft portion 320 of the button member 314. The aperture 328 and the end 340 of the shaft portion 332 may have complementary shapes. In another aspect, the aperture 328 may be oversized relative to the end 340 of the shaft portion 332 and may have ramped sides to more easily permit interaction with the end 340 of the shaft portion 332.

Figure 12:
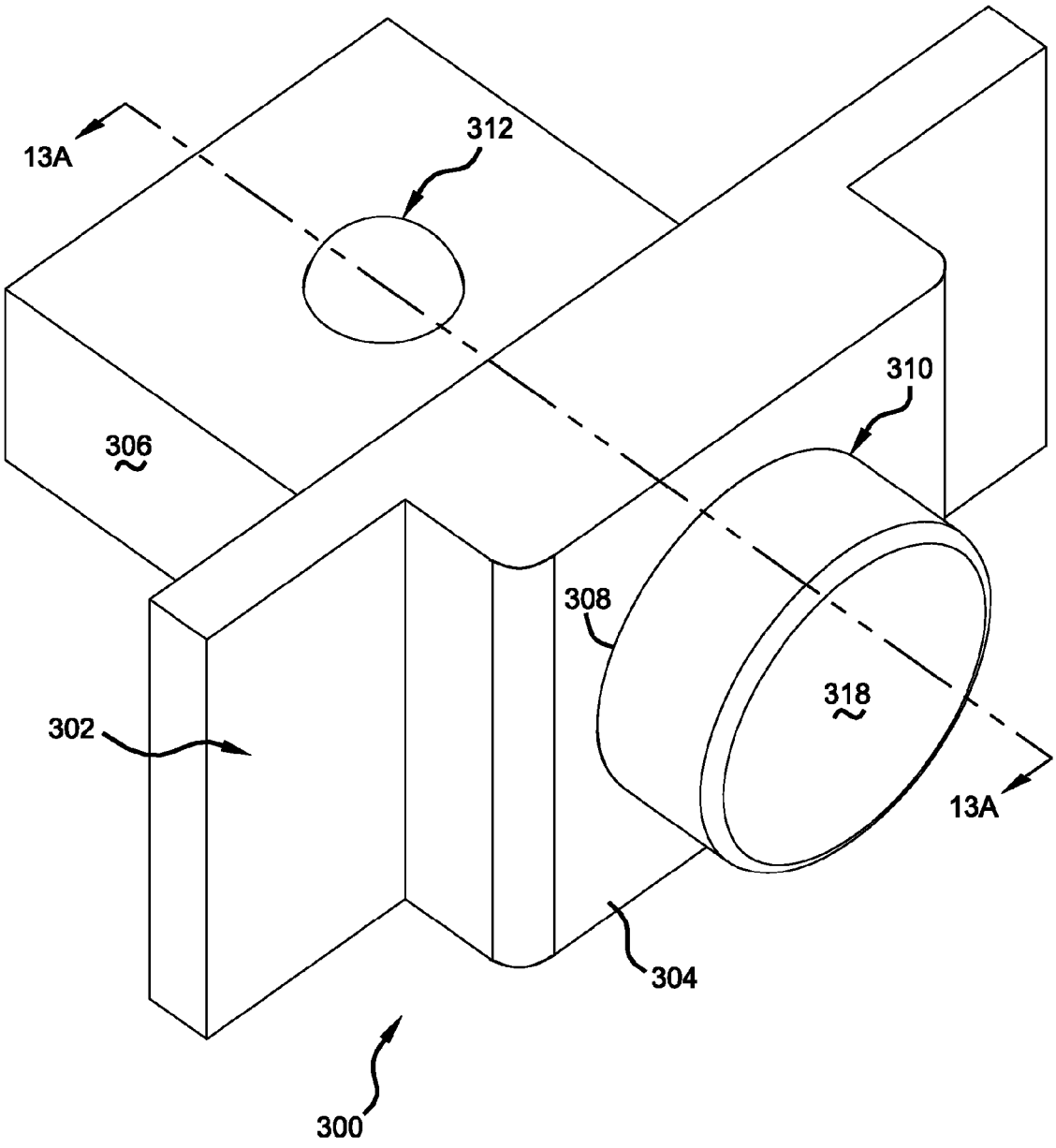
FIG. 12 shows a perspective view of a sliding adjuster member of the depth adjustment mechanism of FIG. 9.
Figure 13A:
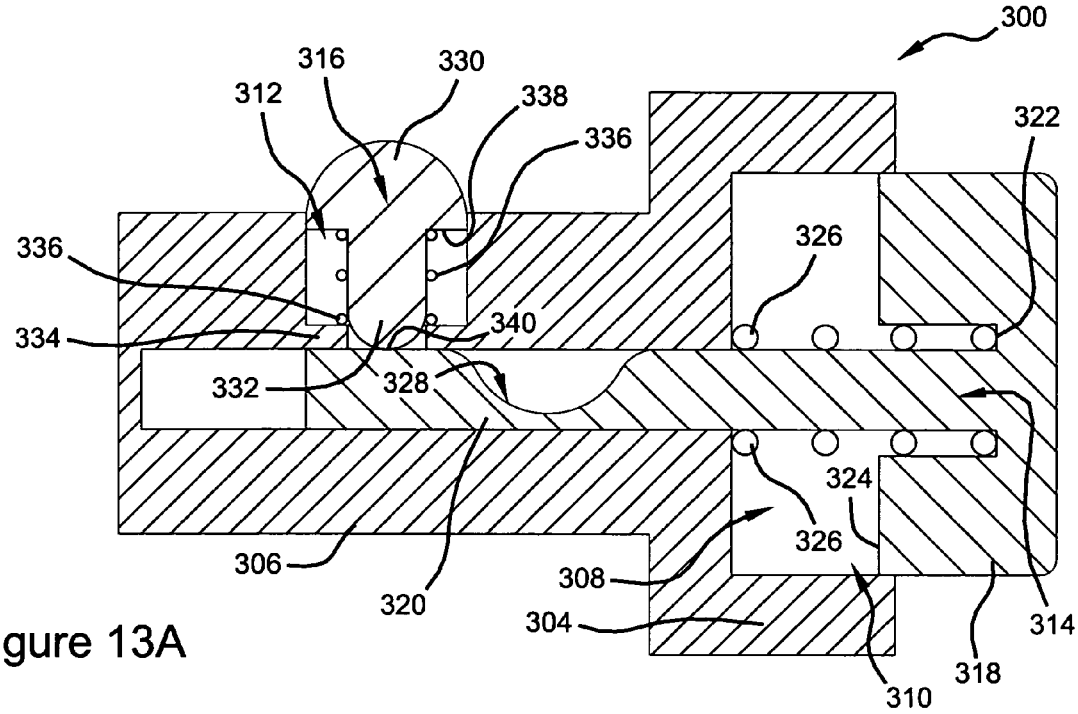
FIG. 13A is a cross-sectional view of FIG. 12 showing a button member and a post member in an extended condition.
Figure 13B:
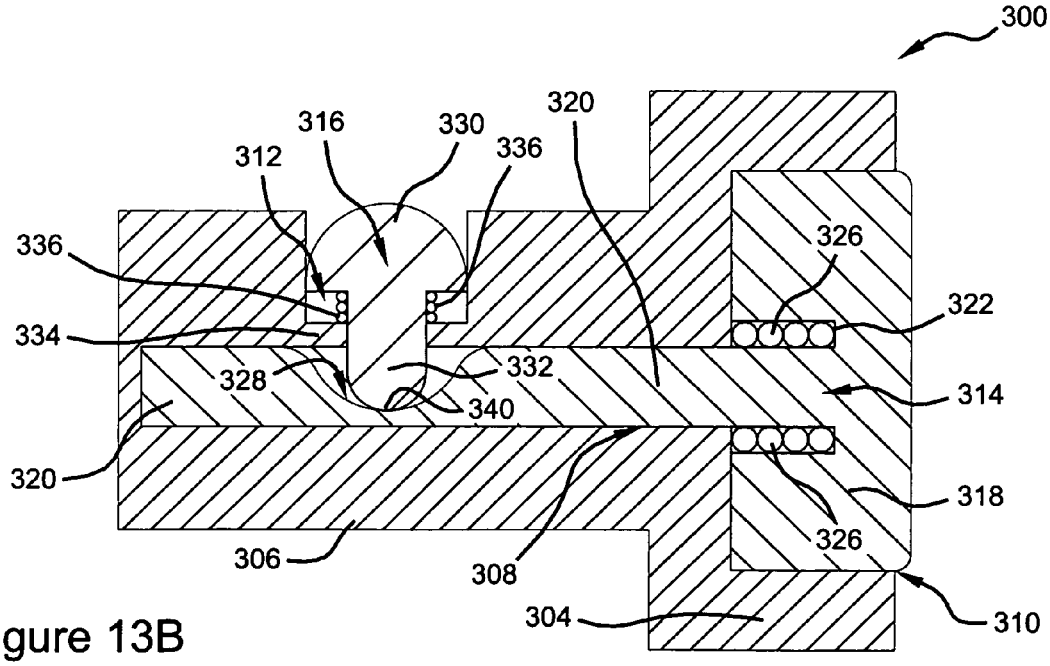
FIG. 13B is similar to FIG. 13A and shows the button member and the post member in a retracted condition.

With reference to FIG. 13A, the spring 326 may hold the button member 314 and the spring 336 may hold the post member 316 in an extended condition. With reference to FIG. 13B, the spring 326 and the spring 336 may be compressed such that the button member 314 and the post member 316 can be in a retracted condition. With reference to FIGS. 12, 13A and 13B, when the button member 314 is in the extended condition, the post member 316 cannot move into the retracted position because the shaft portion 320 of the button member 314 obstructs the shaft portion 332 of the post member 316. When the button member 314 is in the retracted condition, the post member 316 can move into the retracted position because the aperture 328 can accept the end 340 of the shaft portion 320.

Figure 10:
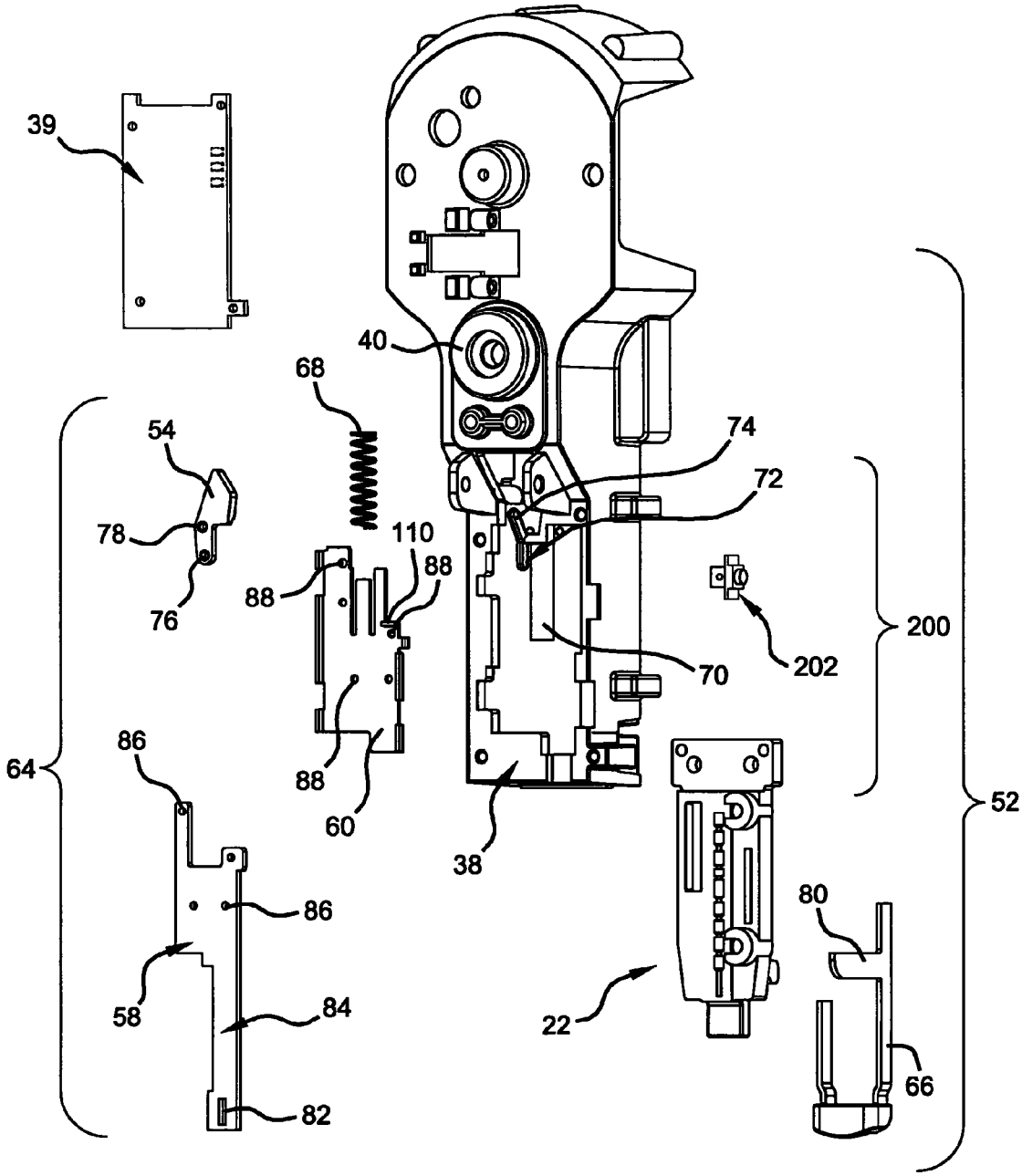
FIG. 10 is an exploded assembly view of the depth adjustment mechanism of FIG. 8A.
Figure 18:
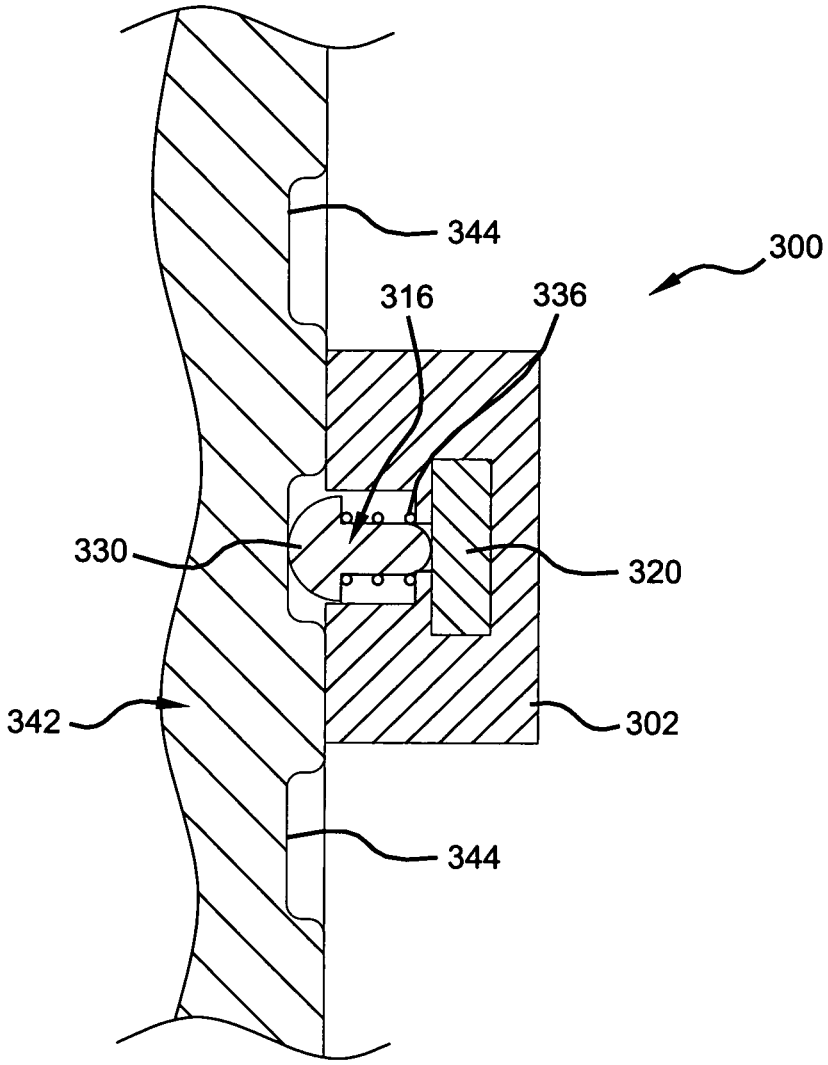
FIG. 18 is a cross-sectional view of FIG. 9 showing a head portion of a post member received in a groove of an index plate on the transmission housing cover in accordance with a further aspect of the present teachings.

In one aspect of the present teachings and with reference to FIG. 18, an index plate 342 may extend from the transmission housing cover 39 (FIG. 10). The index plate 342 may be formed on the transmission housing cover 39 or may be a separate piece coupled thereto. The index plate 342 may contain multiple grooves 344 that may receive the head portion 330 of the post member 316. In operation, the adjuster member 300 can be indexed against the index plate 342 and thus held at certain positions that are associated with the grooves 344 and the above described depth settings.

By pressing the button member 314 so as to move the button member 314 from the extended condition to the retracted condition, the post member 316 can move to the retracted position. With the above in mind, the adjuster member 300 may be moved relative to the index plate 342 only when the button member 314 is in the retracted condition. Because the button member 314 is in the retracted condition, the post member 316 can move from the extended condition to the retracted condition, as the adjuster member 300 can be moved relative to the index plate 342. Specifically, the post member 316 can move into the retracted condition, as the head portion 330 is urged out of the groove 344 of the index plate 342. When the adjuster member 300 is aligned in the next depth adjustment setting that correlates with a certain groove 344, the head portion 330 can move back into that groove 344 and, therefore, can return to the extended condition.

While specific aspects have been described in the specification and illustrated in the drawings, it will be understood by those skilled in the art that various changes may be made and equivalence may be substituted for elements thereof without departing from the scope of the present teachings as defined in the claims. Furthermore, the mixing and matching of features, elements and/or functions between various aspects may be expressly contemplated herein so that one skilled in the art would appreciate from the present teachings that features, elements and/or functions of one aspect may be incorporated into another aspect as appropriate, unless described otherwise above. Moreover, many modifications may be made to adapt a particular situation or material to the present teachings without departing from the essential scope thereof. Therefore, it may be intended that the present teachings not be limited to the particular aspects illustrated by the drawings and described in the specification as the best mode of presently contemplated for carrying out the present teachings but that the scope of the present teachings will include any aspects following within the foregoing description and the appended claims.

What is claimed is:

1. A fastening tool for driving a fastener into a workpiece, the fastening tool comprising:

a trigger assembly that activates a driver sequence that drives the fastener into the workpiece;

a contact trip mechanism having a blocking member connected to a carrier member, said contact trip mechanism moveable between an extended position and a retracted position, in said extended position said blocking member prevents said trigger assembly from activating said driver sequence; and a depth adjustment assembly including an adjuster member moveable between at least a first position associated with a first depth setting and a second position associated with a second depth setting, said adjuster member moveable to abut and end travel of said carrier member toward said adjuster member when said contact trip mechanism moves from said extended position to said retracted position.

2. The fastening tool of claim 1 wherein said adjuster member is rotatable between at least said first position and said second position.

3. The fastening tool of claim 2 further comprising at least a first cam block and a second cam block connected to said adjuster member, said first cam block abuts and ends said travel of said carrier member when said adjuster member is in said first position and said contact trip mechanism is in said retracted position; and said second cam block abuts and ends said travel of said carrier member when said adjuster member is in said second position and said contact trip mechanism is in said retracted position.

4. The fastening tool of claim 3 further comprising a third cam block connected to said adjuster member and spaced circumferentially from said first cam block and said second cam block, said third cam block abuts and ends said travel of said carrier member when said adjuster member is in a third position.

5. The fastening tool of claim 4 wherein a portion of the adjuster member associated with a fourth position is generally flush with a surface to which said first cam block and said second cam block are connected, said portion of said adjuster member abuts and ends said travel of said carrier member when said adjuster member is in said fourth position and said contact trip mechanism is in said retracted position.

6. The fastening tool of claim 2 wherein said adjuster member is rotatable between four positions that each corresponds to different depth settings.

7. The fastening tool of claim 1 wherein said adjuster member indexes against a housing of the fastening tool in at least said first position and said second position.

8. The fastening tool of claim 4 further comprising a fourth position on said adjuster member, wherein said first, second, third and fourth positions on said adjuster member are radially spaced from one another in generally ninety degree increments.

9. The fastening tool of claim 1 wherein said adjuster member is slidable relative to a housing of the fastening tool between at least said first position and said second position.

10. The fastening tool of claim 1 further comprising a housing of the fastening tool to which said trigger assembly is connected, wherein said adjuster member abuts said carrier member within said housing to end said travel of said carrier member toward said adjuster member.

11. A fastening tool for driving a fastener into a workpiece, the fastening tool comprising:

a contact trip mechanism having a carrier member, said contact trip mechanism moveable between an extended position and a retracted position;

a depth adjustment assembly including an adjuster member rotatable between at least a first position and a second position;

a first cam block associated with said first position, said first cam block extends from said adjuster member;

a second cam block associated with said second position, said second cam block extends from said adjuster member and radially spaced from said first cam block; and said adjuster member obstructs a portion of said contact trip mechanism to adjust a depth at which the fastener is driven into the workpiece when said contact trip mechanism is moved into said retracted position, wherein said portion of said contact trip mechanism contacts a portion of said adjuster member within a housing of the fastening tool and wherein said depth at which the fastener is driven into the workpiece is based on at least on of said first position and said second position.

12. The fastening tool of claim 11 further comprising a third cam block that extends from said adjuster member and spaced circumferentially from said first cam block and said second cam block, said third cam block abuts said carrier member when said adjuster member is in a third position.

13. The fastening tool of claim 12 wherein a portion of said adjuster member associated with a fourth position is generally flush with a surface to which said first cam block and said second cam block are connected, said portion of said adjuster member abuts said carrier member when said adjuster member is in said fourth position and said contact trip mechanism is in said retracted position.

14. The fastening tool of claim 13 wherein said adjuster member is rotatable between four positions that each corresponds to different depth settings.

15. The fastening tool of claim 11 wherein said adjuster member indexes against a housing of the fastening tool in at least said first position and said second position.

16. The fastening tool of claim 11, wherein said first cam block extends from a surface of said adjuster member in a direction that is generally perpendicular to an axis of rotation of said actuator member.

17. The fastening tool of claim 11, wherein said adjuster member obstructs said portion of said contact trip mechanism by ending travel of said carrier member toward said adjuster member when said contact trip mechanism moves from said extended position to said retracted position.

* * * * *